US010893697B2

(12) United States Patent
Lin

(10) Patent No.: US 10,893,697 B2
(45) Date of Patent: Jan. 19, 2021

(54) MANUAL CIGARETTE MAKING MACHINE OPERABLE BY A HANDLE LOCATED AT A SIDE OF THE MACHINE

(71) Applicant: Republic Tobacco L.P., Glenview, IL (US)

(72) Inventor: Jeongqiang Lin, Jiangmen (CN)

(73) Assignee: Republic Tobacco L.P., Glenview, IL (US)

( * ) Notice: Subject to any disclaimer, the term of this patent is extended or adjusted under 35 U.S.C. 154(b) by 213 days.

(21) Appl. No.: 16/003,874

(22) Filed: Jun. 8, 2018

(65) Prior Publication Data

US 2019/0364955 A1 Dec. 5, 2019

(30) Foreign Application Priority Data

May 31, 2018 (CN) ..... 2018 1 0551983

(51) Int. Cl.
*A24C 5/42* (2006.01)
*A24C 5/06* (2006.01)

(52) U.S. Cl.
CPC . *A24C 5/42* (2013.01); *A24C 5/06* (2013.01)

(58) Field of Classification Search
CPC ..... A24C 5/42; A24C 5/06; A24C 5/40
See application file for complete search history.

(56) References Cited

U.S. PATENT DOCUMENTS

| | | | |
|---|---|---|---|
| 2,314,734 | A | 3/1943 | Ptasnik |
| 2,731,971 | A | 1/1956 | Kastner |
| 3,491,768 | A | 1/1970 | Paynter |
| 3,688,777 | A | 9/1972 | Kastner |
| 3,732,873 | A | 5/1973 | O'Rear |
| 3,746,011 | A | 7/1973 | Kappeler et al. |
| 3,886,952 | A | 6/1975 | Kastner |
| D250,965 | S | 1/1979 | Moscovitch |
| 4,230,132 | A | 10/1980 | Crisp |

(Continued)

FOREIGN PATENT DOCUMENTS

| | | | |
|---|---|---|---|
| CA | 2745159 | A1 | 12/2012 |
| EP | 1872672 | A1 | 1/2008 |
| WO | 2004047569 | A2 | 6/2004 |

OTHER PUBLICATIONS

Canadian Patent Office Action for Application No. 3,017,331 dated Jan. 14, 2020 (3 pages).

(Continued)

*Primary Examiner* — Eric Yaary
*Assistant Examiner* — Jennifer A Kessie
(74) *Attorney, Agent, or Firm* — Michael Best & Friedrich LLP

(57) ABSTRACT

A manual cigarette making machine including a casing with top and side walls, a compacting chamber access opening in the top wall located above a compacting chamber for receiving loose tobacco, a handle mounted for rotation generally perpendicular to the top wall attached to a drive-shaft extending through the sidewall into the machine casing, a cam-driven tamper mechanism operated by the drive-shaft for compressing loose tobacco in the compacting chamber, a cam-driven tobacco injection assembly operated by the drive shaft with an injection drive plate mounted for rotation generally parallel to the top wall, and a tobacco spoon associated with the tobacco injection assembly for transporting compressed tobacco from the compacting chamber to a hollow cigarette tube.

21 Claims, 16 Drawing Sheets

(56) References Cited

U.S. PATENT DOCUMENTS

| | | | |
|---|---|---|---|
| 5,088,506 | A | 2/1992 | Kastner |
| 5,526,825 | A | 6/1996 | Ruppert et al. |
| 6,557,560 | B2 | 5/2003 | Kastner |
| D613,033 | S | 4/2010 | Lin |
| D659,901 | S | 5/2012 | Lin |
| D665,126 | S | 8/2012 | Lin |
| 8,261,752 | B2 | 9/2012 | Bao |
| D700,399 | S | 2/2014 | Lin |
| 9,038,641 | B2 | 5/2015 | Moser et al. |
| 9,277,766 | B2 | 3/2016 | Chen |
| 9,380,808 | B2 | 7/2016 | Bao |
| D769,521 | S | 10/2016 | Lin |
| D840,249 | S | 2/2019 | Payne |
| 10,231,480 | B1 | 3/2019 | Parcevaux |
| 2004/0099277 | A1 | 5/2004 | Moser et al. |
| 2006/0096604 | A1 | 5/2006 | Moser et al. |
| 2010/0229880 | A1 | 9/2010 | Bao |
| 2014/0034069 | A1 | 2/2014 | Chen |
| 2014/0123985 | A1 | 5/2014 | Lin |
| 2014/0202471 | A1 | 7/2014 | Bao |
| 2016/0205994 | A1 | 7/2016 | Lin |
| 2016/0374389 | A1 | 12/2016 | Bao et al. |

OTHER PUBLICATIONS

Extended European Search Report from the European Patent Office for Application No. 18196051.9 dated Mar. 15, 2019 (4 pages).
Australian Patent Office Examination Report No. 1 for Application No. 2018229495 dated Dec. 16, 2019 (6 pages).

MANUAL CIGARETTE MAKING MACHINE OPERABLE BY A HANDLE LOCATED AT A SIDE OF THE MACHINE

FIELD OF THE DISCLOSURE

This disclosure pertains to manually operated cigarette-making machines and, more particularly, to manually operated cigarette-making machines designed to rest generally on a horizontal support surface while operated by a handle at the side of the machine.

BACKGROUND

Many types of manual cigarette making machines for injecting tobacco into hollow tobacco tubes have been developed over the years including handheld and tabletop manual cigarette making machines. The prior tabletop machines are hand-driven in whole or in part by rotating a crank, handle, lever or knob in a plane parallel to the tabletop supporting the machine, by rotating a crank or handle in a plane perpendicular to the tabletop (or other surface) supporting the machine or by sliding a lever or knob in a plane parallel to the tabletop. Manual tabletop cigarette making machines operated in whole or in part by rotating a crank or a handle in a plane perpendicular to the tabletop supporting the machine are sometimes referred to as "side handle operated machines".

Manual cigarette making machines must compress loose tobacco in a uniform, reliable and repeatable manner. They must also transport or inject the compressed tobacco into hollow cigarette tubes smoothly, and in a fashion that ensures a proper, uniform and complete fill of the tubes. And, most importantly, these machines must be easy to operate and they must stand up to repeated use over time without losing their ability to compress the loose tobacco in a uniform, reliable and repeatable manner or to inject the compressed tobacco into hollow cigarette tubes smoothly and in a way that ensures proper, uniform complete fill of the tubes.

Some users of manual cigarette making machines prefer side handle operated machines. The present application is directed to machine embodiments that are designed to be hand driven in this way and that are particularly well adapted to compressing loose tobacco in a uniform, reliable and repeatable manner. The present machine embodiments also are particularly well adapted to injecting the compressed tobacco into hollow cigarette tubes smoothly, and to ensure a proper, uniform and complete fill of the tubes. And, the present machine embodiments are easy to operate and will stand up to repeated use over time without losing their ability to compress the loose tobacco and to inject the compressed tobacco into hollow cigarette tubes.

SUMMARY

Embodiments comprise a manual cigarette making machine with a top wall and a sidewall, and a compacting chamber access opening in the top wall located above the compacting chamber within the machine. The compacting chamber is intended to receive loose tobacco which will be compacted and injected into a hollow cigarette tube.

The machine embodiments include a handle mounted for rotation in a plane generally perpendicular to the top wall of the machine casing. The handle is attached to a driveshaft that extends through the sidewall into the machine casing.

An attachment member stub may be affixed to the driveshaft to be received in an attachment channel in the handle to enable the handle to be removably attached to the driveshaft. The stub may be provided with a spring biased pin while the channel wall is provided with a bore positioned to receive the pin. This arrangement permits the handle to be attached to the driveshaft by sliding the stub into the channel until the pin reaches and snaps into place in the bore in the channel. When it is desired to remove the handle, the pin is pushed in until it is out of engagement with the bore and the handle may be slid off the stub.

Machine embodiments also include a cam-driven tamper mechanism operated by the driveshaft. As the handle is rotated it operates a cam structure to advance a tamper toward the compacting chamber bottom to compress loose tobacco in the compacting chamber. The tamper mechanism may include a tamper member mounted for linear movement in the compacting chamber toward and away from a tobacco spoon located at the bottom of the compacting chamber. The tamper member may include one or more wheels for engaging one or more cam surfaces and advancing the tamper member in response to rotation of the cam surfaces. The tamper member preferably will have a rounded upwardly directed trough which generally corresponds to the circumference of the compacted tobacco cylinder which is to be injected into a cigarette tube.

Embodiments of the machine employ a cam-driven tobacco injection assembly operated by the rotation of the driveshaft. This tobacco injection assembly includes an injection drive plate mounted for rotation generally parallel to the top wall of the machine casing, or generally perpendicular to the plane of movement of the handle.

Embodiments of the injection plate of the injection assembly including a pivot end a free end spaced from the pivot end. A tobacco spoon is linked to the injection plate, preferably at its free end. This tobacco spoon is will rest at the bottom of the compacting chamber before the injection process initiated. The tobacco spoon is arranged to move across the bottom of the compacting chamber as the injection plate pivots about its pivot end to transport or inject compressed tobacco from the compacting chamber into an empty cigarette tube in response to rotation of the injection drive plate.

The tobacco spoon preferably is mounted for linear movement across an injection track as the free end of the injection plate moves in an arc. A swing arm is preferably rotatably mounted at one end to the machine casing and at the other end to the tobacco spoon. This swing arm may be articulated. Finally, the free end of the injection plate is linked to the swing arm causing pivotal movement of the injection plate to be converted into linear movement of the tobacco spoon.

In embodiments of the cigarette making machine a drive member is provided mounted for linear movement generally perpendicular to the axis of the driveshaft. An opening may be provided in the injection drive plate spaced from the pivot end of the plate for receiving this drive member. As a result, linear movement of the drive member within the opening will produce pivotal movement of the drive plate about its pivot end. The injection drive plate opening may include a shelf that is generally perpendicular to the injection drive plate so that the drive member engages the shelf as it moves linearly. The drive member may further have an angled flat leading surface that engages the shelf. Finally, the flat leading surface may have a hardened portion where it contacts the shelf to help reduce wear.

In embodiments of the machine, the tobacco injection assembly will be driven by a cam assembly operated by the driveshaft. This cam assembly may include a central cam member with a cam surface and at least one lateral stop member. The central cam member may have a cam surface including an initial lobe, a drop and a final lobe which engages a carriage plate to which the drive member is attached. The carriage plate may have a wheel engaging the central cam member surface. The initial lobe ensures that the carriage plate and drive member remain in place during the initial rotation of the cam, while the empty cigarette tube is being locked in place by the clamping structure described below. As the central cam member continues to rotate, the wheel rides into the drop and then up upon the final lobe, which causes the carriage plate and drive member to advance at the appropriate time in the operation of the machine.

The cam assembly may also include one or more lateral stop members having engagement surfaces. These lateral stop members, which are mounted to the driveshaft adjacent the central cam member, include engagement surfaces positioned relative to the central cam member to provide a positive stop when they come into engagement with the top surface of the carriage plate, thereby establishing a positive closed position in the rotation of the handle.

Embodiments of the cigarette making machine may also including nipple for receiving an open end of the cigarette tube and a clamping structure for removably retaining the cigarette tube on the nipple to receive compacted tobacco transported from the compacting chamber. This clamping structure will be operated by the driveshaft. In the illustrated embodiment the clamping structure may include a clamp driver wheel mounted to the driveshaft to engage a structure for advancing a clamp finger against a cigarette tube positioned on the nipple.

The machine may also include an optional cigarette tube adjustment mechanism for reducing the tobacco-receiving volume of the compacting chamber to accommodate the filling of different cigarette tube lengths.

In embodiments of the invention, the tamper mechanism, injection assembly and tube clamping structure will be arranged radially on the driveshaft so that rotation of the driveshaft from its initial or "open" during insertion of tobacco in the compacting chamber, to first drive the clamping structure from an open to a closed position, then drive the tamper mechanism from a rest to a fully extended position compacting the tobacco against a cigarette spoon located at the bottom of the compacting chamber, and then drive the tobacco injection assembly from a rest to a fully tube engaged position to fill an empty cigarette tube, which will mark the end of the forward rotation of the handle, or its "closed" position. As the handle is returned to its open position, the clamping structure will be released, the spoon will be withdrawn from the now-filled cigarette tube and the tamper will be returned to its start position.

BRIEF DESCRIPTION OF THE DRAWINGS

Features, objects and advantages of embodiments may be best understood by reference to the following description, taken in connection with the following drawings, in which like reference numerals identify like elements in the several figures, and in which.

DESCRIPTION

Figure 1:
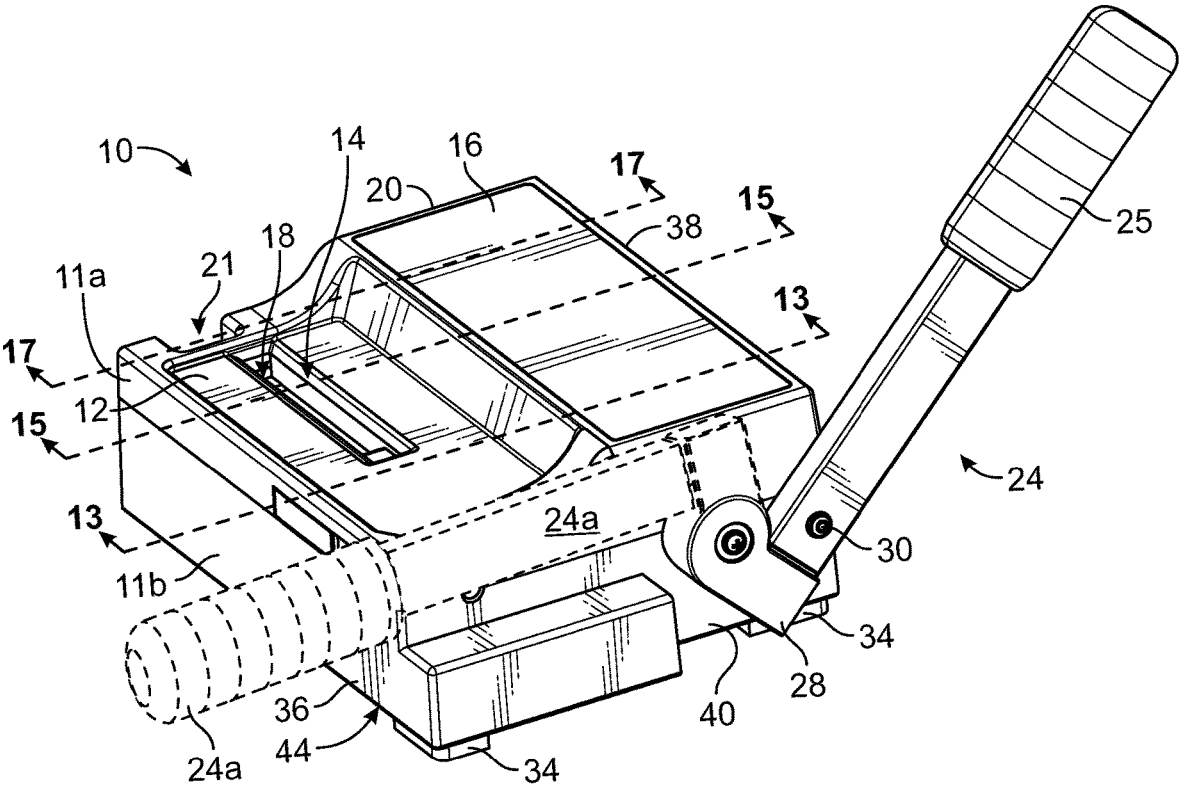
FIG. 1 is a perspective view of a manually operated side handle operated cigarette-making machine in accordance with embodiments of the invention.

A manually operated cigarette-making machine embodiment 10 of the invention is depicted in perspective view in FIG. 1 comprising top machine casing component 11*a* and bottom machine casing component 11*b*. The machine embodiment includes a lower platform 12 of top machine casing component 11*a*, a compacting chamber access opening 14, an upper platform 16 of top machine casing component 11*a* which is generally parallel to the lower platform, and a compacting chamber 18 which lies below the chamber access opening. Top and bottom machine casing components 11*a* and 11*b* are joined to form cigarette machine casing 11.

Platforms 12 and 16 are available to hold a quantity of loose tobacco, hollow cigarette tubes, etc., as desired, in preparation for operation of machine 10. Loose tobacco will be manually placed through access opening 14 into compacting chamber 18 before operating the machine.

Figure 19:
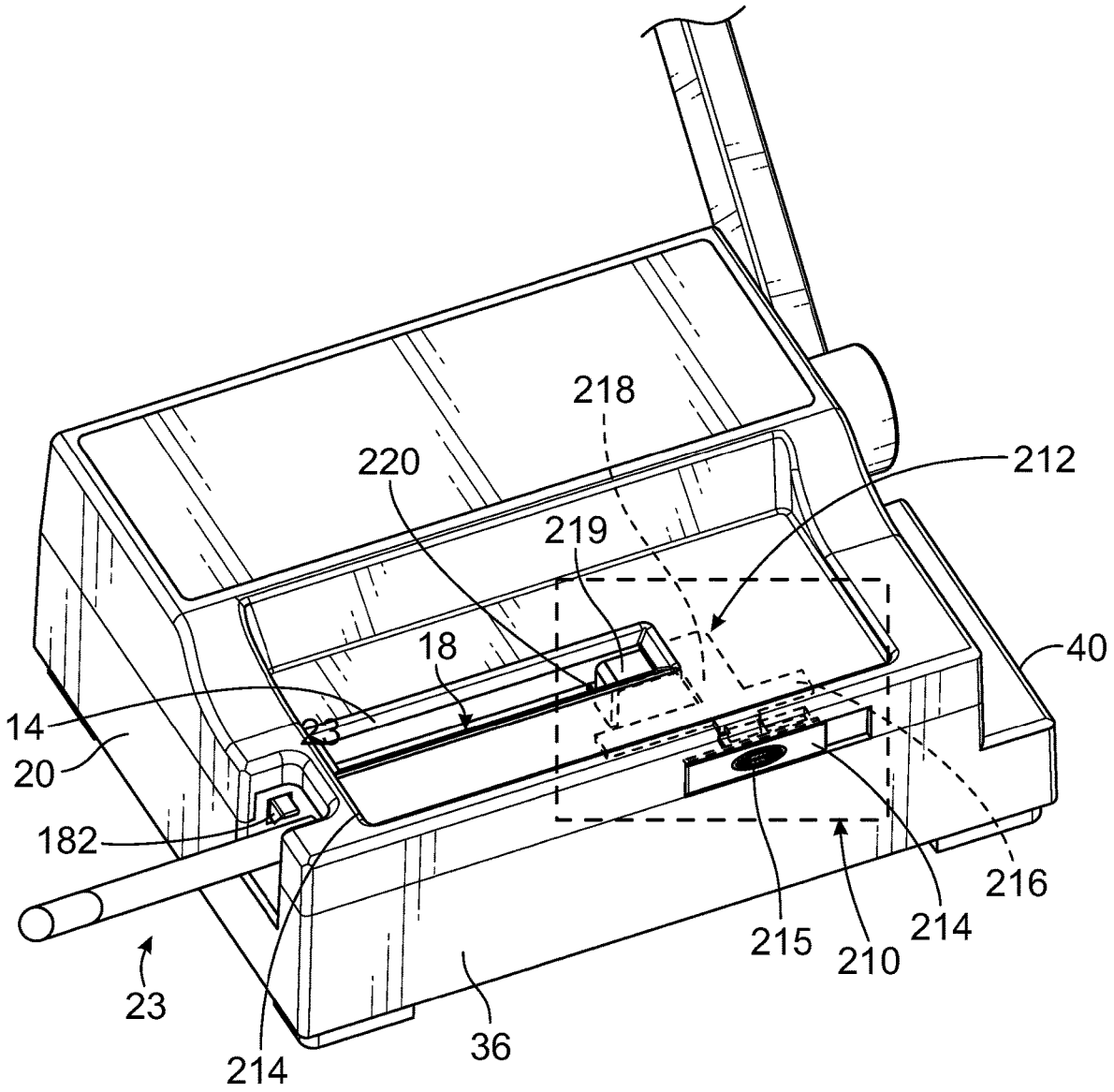
FIG. 19 is a perspective view of an embodiment of the cigarette-machine of FIG. 1 with a broken line rectangle superimposed on the cigarette tube adjustment mechanism embodiment thereof to indicate the corresponding portion of the machine illustrated in FIGS. 20A and 20B.

The top and bottom machine casing components are assembled together to form casing 11. The machine embodiment as shown for example in FIGS. 1 and 19, has a first side wall 20, a cavity in the first side wall 21 and a nipple 22 which extends into cavity 21. Tobacco which is compressed into a cylinder by the machine will be injected by tobacco injection assembly 48 described below through the nipple and into the hollow cylinder 23*b* of cigarette tube like tube 23 (FIGS. 12 and 19) mounted on the nipple during the operation of machine embodiments, as explained below.

Cigarette-making machine embodiment 10 is shown with an optional cigarette tube adjustment mechanism 210 which may be seen in FIGS. 11, 12, and 20A-20B. This mechanism enables compacting chamber 18 to be shortened when necessary or desirable to meter the amount of tobacco to accommodate a cigarette tube 23 with a shorter tobacco-receiving cylinder 23*b*.

Machine embodiments also include a handle 24 with a handle grip 25 at its distal end. Handle 24 appears, for example, in the perspective view of the machine embodiment of FIG. 1 and is also illustrated in the partial views of FIGS. 2 and 3. After tobacco is placed in compacting chamber 18, handle 24 will be moved from the initial position shown in solid lines in FIG. 1 to the completion position of phantom handle depiction 24*a* (shown in broken lines) to form a compacted tobacco cylinder, as noted above, and to transport or inject this compacted tobacco cylinder into the hollow cylinder 23*b* of cigarette tube 23 mounted to nipple 22. Once this process is completed, handle 24 will be returned to the initial position and the now tobacco-filled cigarette tube will be removed from the nipple.

Figure 2:
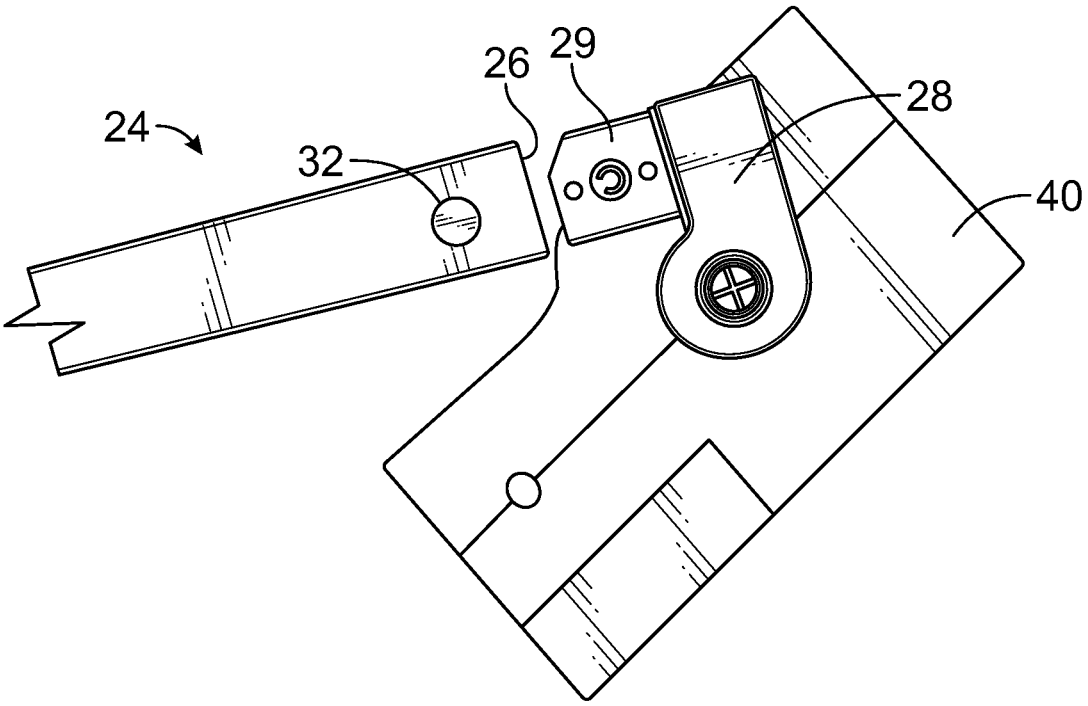
FIGS. 2 and 3 are partial side and perspective views of a side operating handle attachment embodiment of a cigarette-making machine as in FIG. 1.
Figure 3:
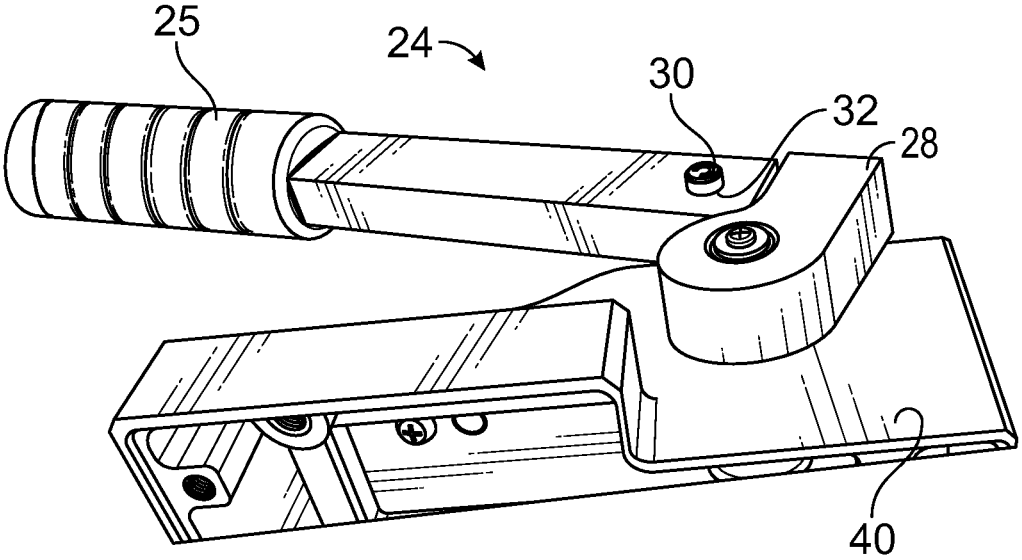
Figure 5:
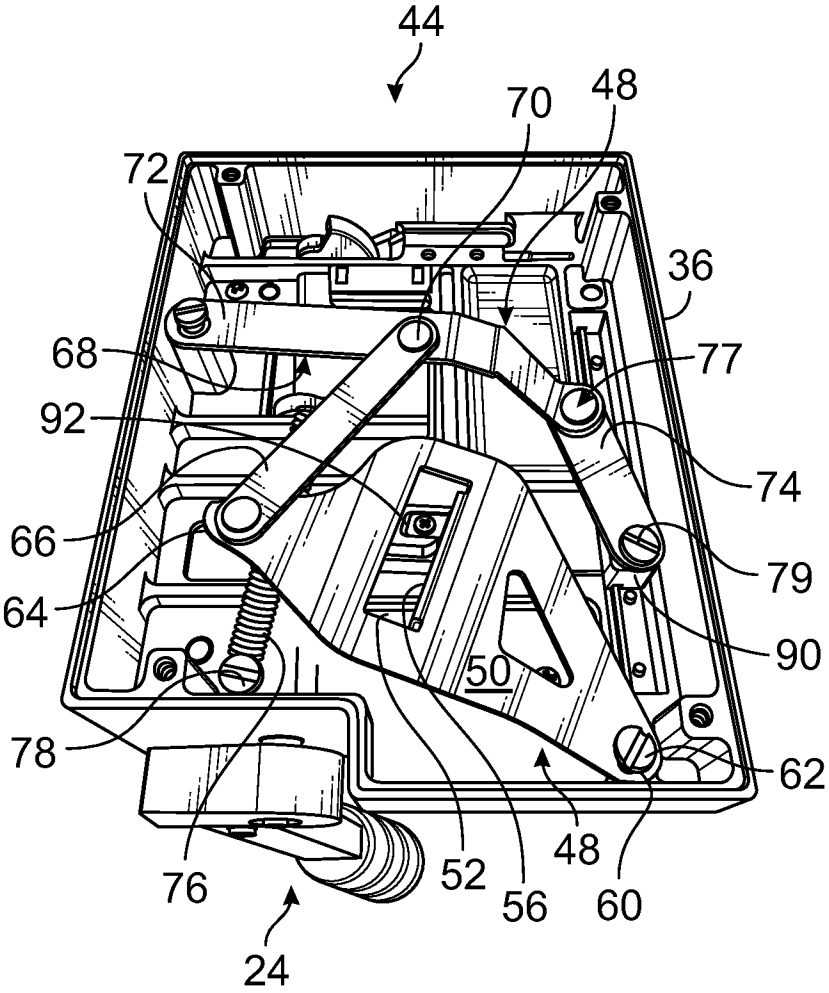
FIGS. 4-7 are open bottom perspective views of a machine embodiment as depicted in FIG. 1 illustrating the movement of a tobacco injection assembly as the handle of the machine embodiment advances during operation of the machine.

As shown in FIGS. 2 and 3, handle 24 includes a handle attachment channel 26 at its proximal end as well as a handle-to-machine attachment member 28 (attached to driveshaft 100 described below). Attachment member 28 includes an attachment member stub 29 that is received in channel 26 when the handle is removably affixed to attachment member 28 as illustrated in FIGS. 1 and 3. Attachment member stub 29 has a spring-biased pin 30 positioned and dimensioned to fit into a bore 32 in the side wall of the handle portion defining channel 26. Bore 32 is adjacent the proximal end of the handle attachment channel. The handle therefore may be released from the stub to facilitate storage of the machine by pressing upon the pin until it is clear of the wall of the channel and the handle can be removed. The handle may be re-attached by pressing it home on the attachment member stub until the pin clears the open end of the channel and pops into place in bore 32.

The fully assembled machine embodiment depicted in FIG. 1 includes a front wall 36, a back wall 38, first side wall 20, a second side wall 40 and a bottom 44. Handle 24 moves in an arc during the operation of the machine embodiment. This arc lies in and therefore defines a plane referred to below as the "handle plane of movement", which is labeled "35" in FIG. 7A. Machine embodiment 10 may have rubber or other elastomeric feet 34 as shown in FIG. 1 for resting on a generally horizontal supporting surface (not shown) and resisting movement of the machine embodiment on the horizontal supporting surface while it is operated. Top and bottom machine casing components 11*a* and 11*b* are joined to form cigarette machine casing 11.

Figure 7:
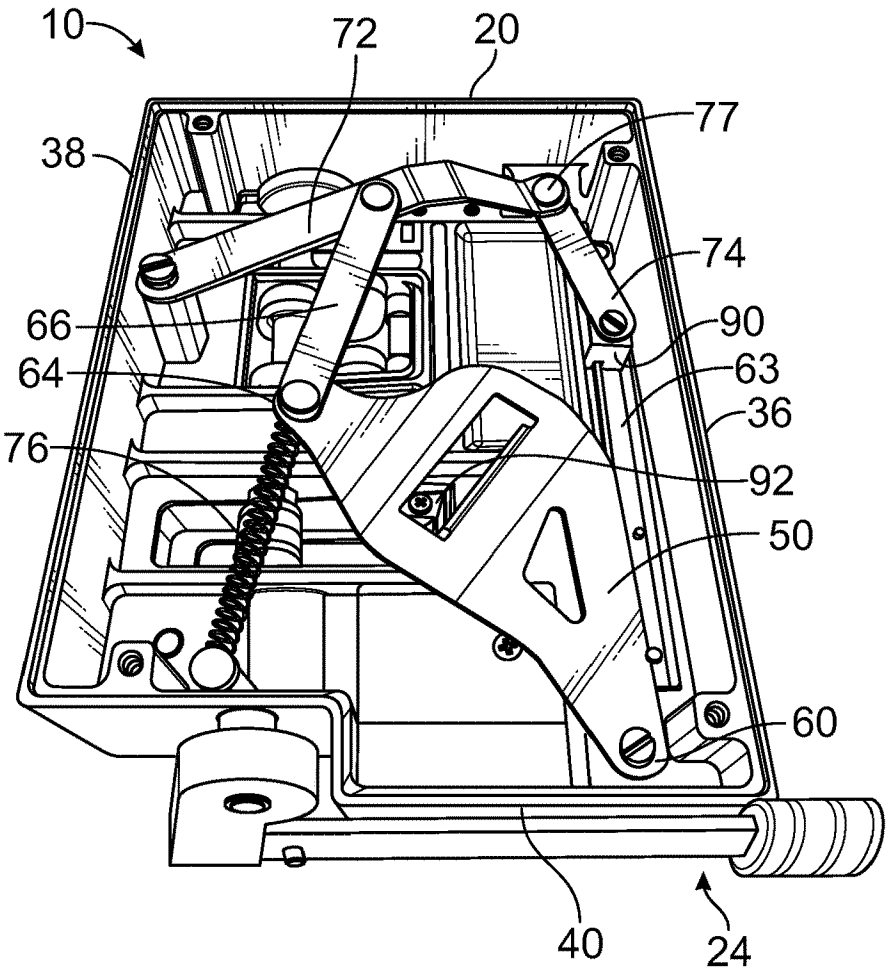
Figure 6:
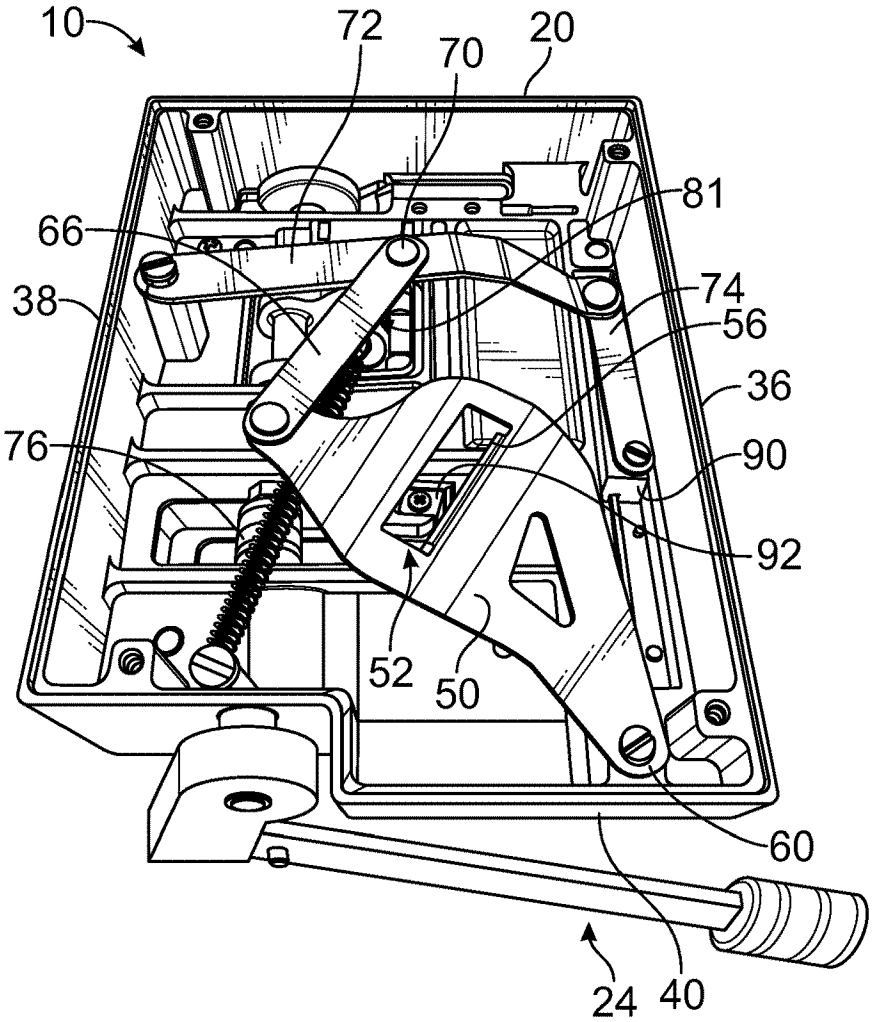

Turning now to FIGS. 4-7, open bottom views of the machine embodiment depicted in FIG. 1 are shown to reveal how the tobacco injection assembly 48 operates as handle 24 is moved in an arc generally parallel to side walls 20 and 40 and generally perpendicular to platforms 102 and 103 from its initial position depicted in FIG. 1 to its completion position shown in broken lines (phantom of handle 24*a*) in FIG. 1 and in solid lines in FIGS. 1 and 7.

We turn now to the structure and operation of the machine components illustrated in these FIGS. 4-7 that cooperate in the tobacco injection operation of the machine. First, tobacco injection assembly 48 comprises an injection drive plate 50. The injection drive plate and its links operate in a plane referred to herein as the "injection drive plate plane of movement". This injection drive plane of movement is generally perpendicular to the handle plane of movement, as diagrammatically depicted in FIG. 7A.

The drive plate has a rectangular opening 52 with an elongated shelf 56 along the top edge of the rectangular opening when the machine embodiment is viewed from the bottom as in FIGS. 4-7. The elongated shelf, which is generally perpendicular to the drive plate, may be formed by stamping out the bottom and sides of opening 52 and then bending the stamped out portion back to form the elongated shelf which projects upwardly from the drive plate in this figure toward platforms 12 and 16 of the machine.

Drive plate 50 is pivotally attached at pivot end 60 to pivotal mounting member 62. This pivotal mounting member and hence the pivot point of the drive plate is therefore located adjacent the start point 65 (FIG. 4) of injection track 63, which will be described in more detail below. The opposite free end 64 of the drive plate therefore is therefore designed to swing in an arc about pivot end 60.

A link arm 66 is rotatably affixed to the drive plate at end 64. The second end of link arm 66 is rotatably affixed to a swing arm 68 which articulates in two sections 72 and 74 at an articulation point 77. As can be seen in FIGS. 4-7, link arm 66 is rotatably attached at an intermediate point 70 along section 72 of the swing arm. Therefore, as the injection drive plate moves toward front wall 36 during operation of the machine embodiment, the free end 64 of the plate moves in an arc lying in the injection plate plane of movement toward the front wall.

Figure 4:
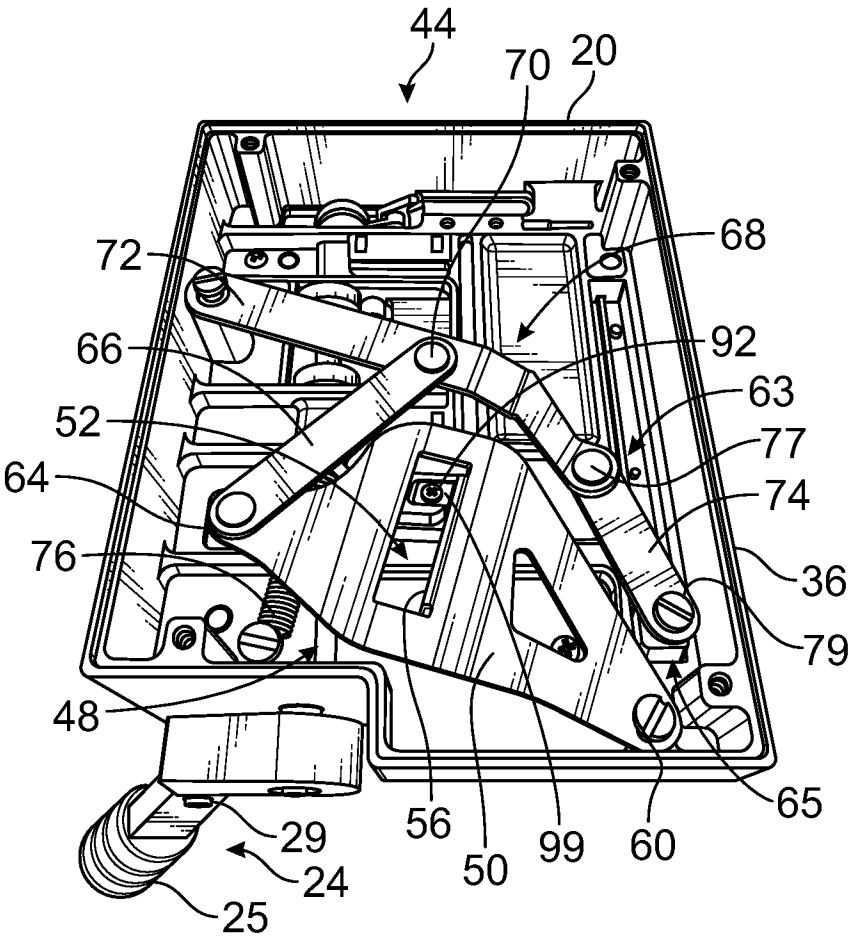

The injector member drive plate is shown in its initial rest position in FIG. 4. The drive plate and swing arm are biased in this position by tobacco swing arm return spring 76 which is affixed at return spring anchor point 78 and at the other end to an intermediate Point 81 on the bottom of link arm 66 as can best be seen in FIG. 6.

Section 74 of the swing arm is shown pivotally attached at its distal end 79 to tobacco spoon slide support 90. This slide support is associated with tobacco spoon 91 (FIG. 9) which is designed to move linearly on injection track 63 toward side wall 20 and nipple 22 to inject a compacted tobacco cylinder formed in compacting chamber 18 tobacco-receiving cylinder 23*b* of cigarette tube 23 mounted on nipple 22 until the tobacco reaches filter 23*a* of the tube which provides a stop against which the compressed tobacco is injected. Rotating handle 24 rotates the drive plate from its initial position to its completion position indicated by handle phantom 24*a* of FIG. 1 by engagement of the drive member with the rectangular opening in the drive plate. Once the compacted tobacco cylinder is properly in place in the tobacco-receiving cylinder of the cigarette tube, the handle will be rotated back to its initial position, to reverse the movement of the slide support and withdraw the tobacco spoon from the now filled tube.

The advancement of tobacco spoon slide support 90 and tobacco spoon 91 are controlled by the pivotal motion of injection drive plate 50 in the injection drive plane of movement. Thus, beginning with FIG. 4, tobacco injector drive member 92 which is located behind drive plate rectangular opening 52 abuts elongated shelf 56 at the top edge of the rectangular opening. This drive member is mounted for movement generally parallel to the handle plane of movement, as can be seen, for example, in FIGS. 8-10.

Figure 8:
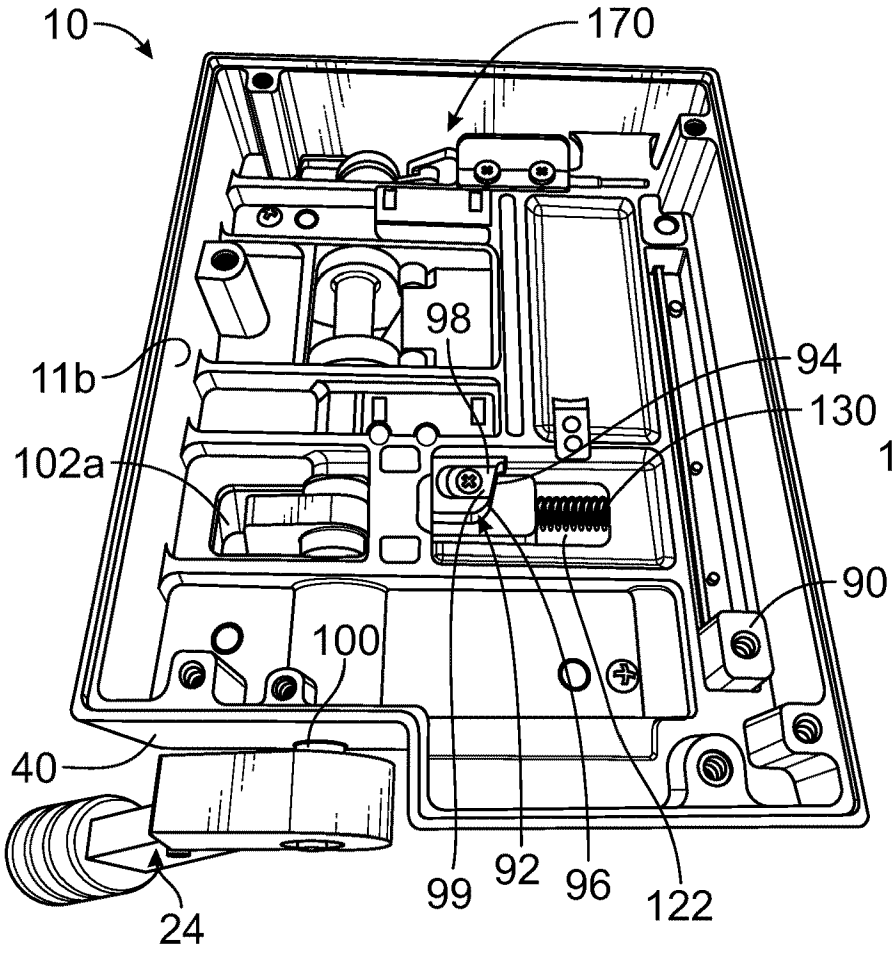

Drive member 92 may be viewed more closely in FIG. 8 which shows its flat leading surface 94 which is preferably at an obtuse angle in relation to the handle plane of movement running from point 96 on the drive member which is closest to start point 65 of injection track 63 toward point 98 on the drive member which is closest to nipple 22 through which the compacted tobacco cylinder formed in compacting chamber 18 passes into a hollow tube mounted on the nipple. The obtuse angle preferably corresponds to the angle of elongated shelf 56 in order to maximize initial contact between surface 94 and the surface of the shelf as the drive member begins advancing in response to the arcuate motion of handle 24 to initiate the injection of the compacted tobacco cylinder into a hollow tube mounted to nipple 22. The drive member may have a hardened insert 99 to help resist wear over time.

The drive member is biased into the injection start position illustrated in FIG. 8 by spring 130. Movement of the drive member is controlled by a cam operated by driveshaft 100 associated with handle 24 which will be described in more detail below.

Figure 7A:
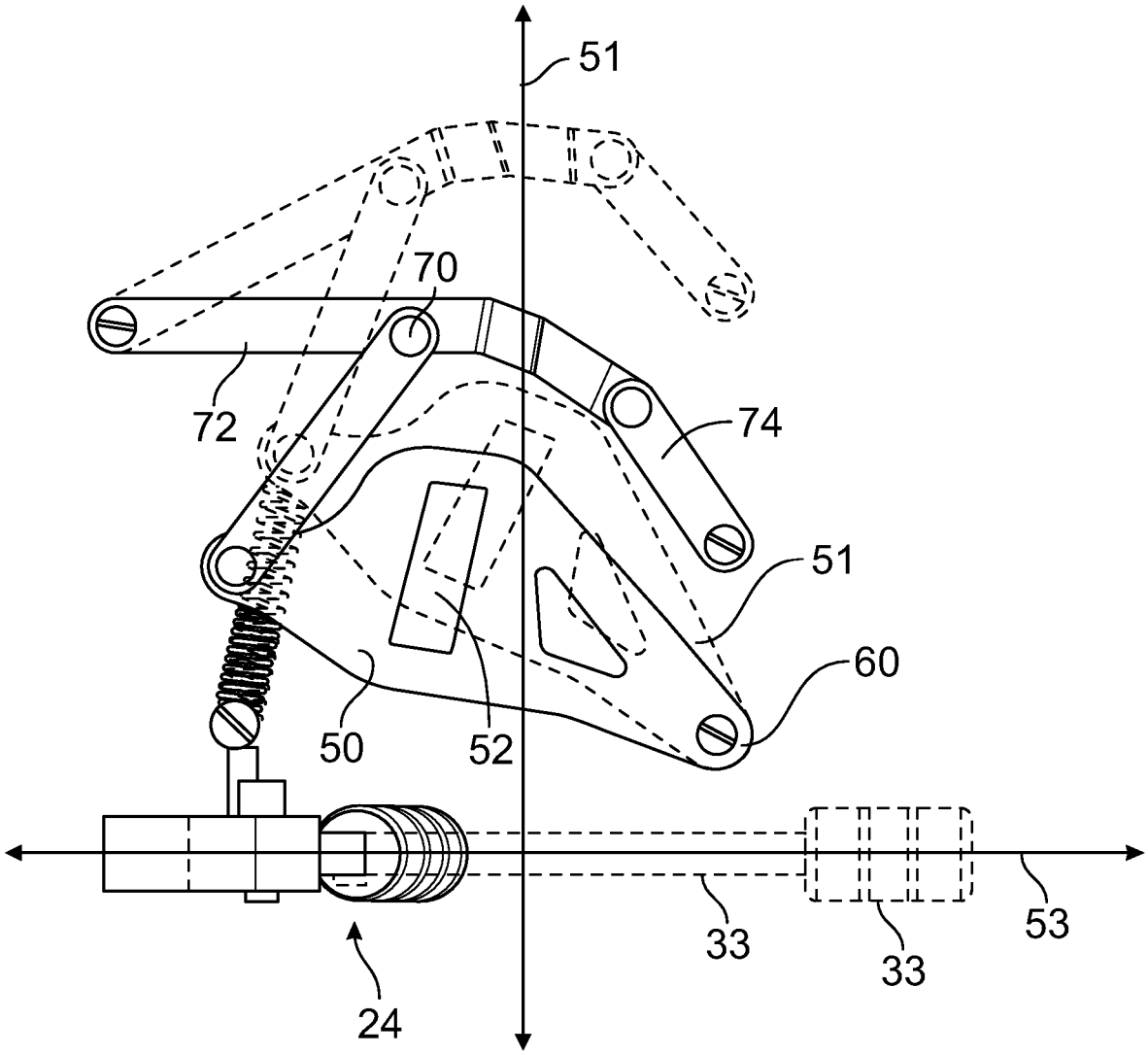
FIG. 7A is a representation of the perpendicular planes of movement of the side handle and the injection drive plate of the machine embodiment depicted in FIG. 1.
Figure 13:
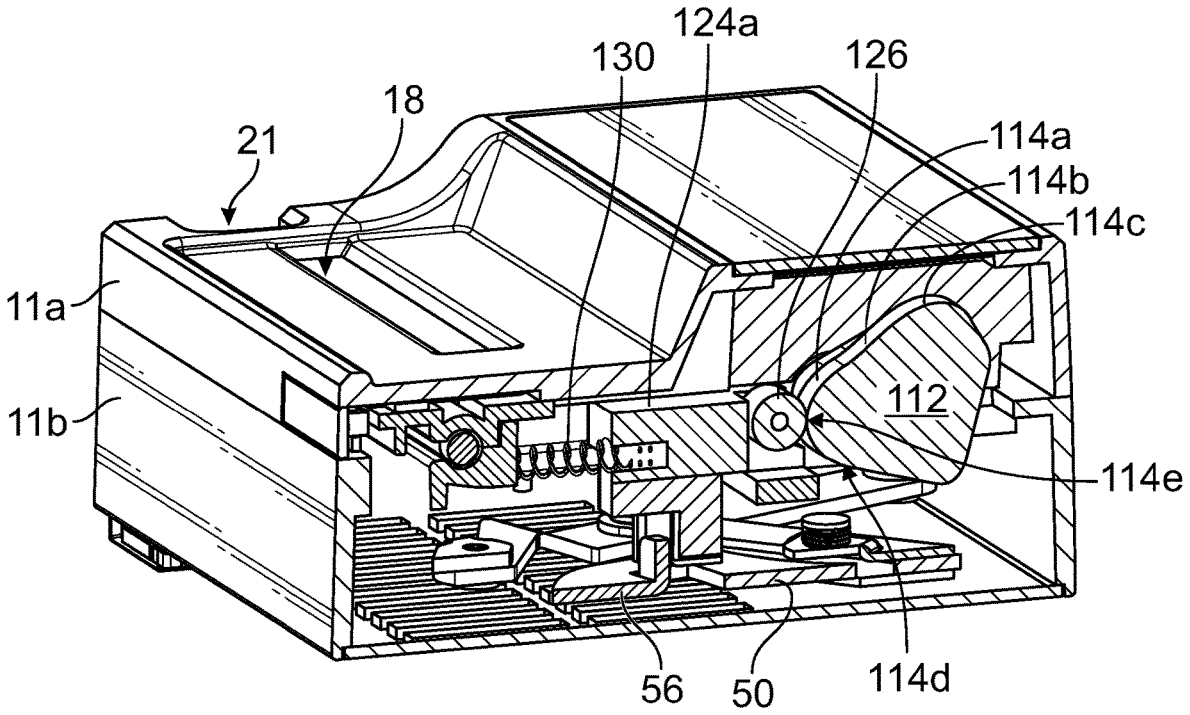
FIG. 13 is a cutaway view of the machine embodiment depicted in FIG. 1 taken along a plane perpendicular to the bottom of the machine passing through line 13-13 in FIG. 1.

As handle 24 is rotated from its initial position shown in FIG. 4 to its final position shown in FIG. 7, drive member 92 and hence tobacco injection assembly 48 initially remains in the position depicted in FIG. 4 while the compacting mechanism of the machine is operated by the advancing handle. FIG. 7A is a representation of the perpendicular planes of movement of the side handle and the injection drive plate of the machine embodiment depicted in FIG. 1. After the compacting mechanism has completed compressing the tobacco in compacting chamber 18 into a compacted tobacco cylinder, continued rotation of the handle then causes the drive member 92 to move toward front wall 36 with its angled flat leading surface 94 initially pressing against elongated shelf 56, initiating movement of the tobacco injection assembly. FIG. 13 is a cutaway view of the machine embodiment depicted in FIG. 1 taken along a plane perpendicular to the bottom of the machine passing through line 13-13 in FIG. 1.

This movement of the drive member causes injection member drive plate 52 to pivot about pivotal mounting member 60 as the injector drive member moves toward machine front wall 36 advancing along shelf 56. As the drive plate pivots in this way, link arm 66 pushes swing arm 68, causing section 74 of the swing arm to follow the movement of the drive plate causing tobacco spoon slide support 90 and tobacco spoon 91 to move toward nipple 22 which will be holding a cigarette tube when the machine is operated to make a cigarette.

Figure 9:
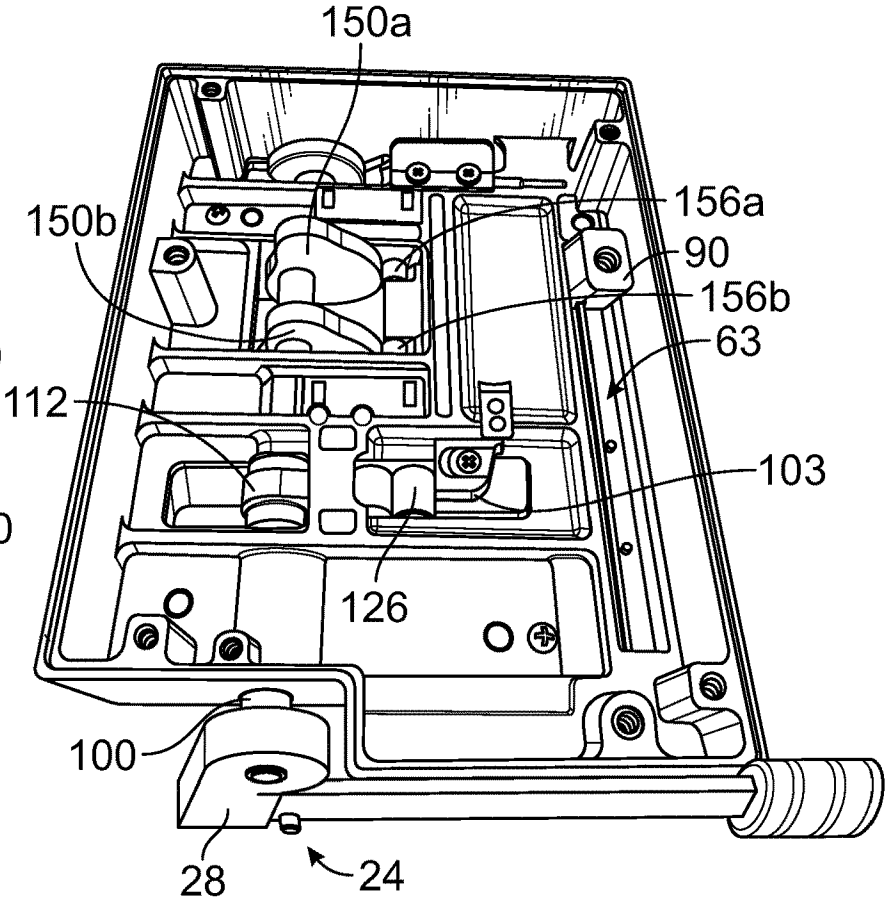
FIGS. 8, 9 and 10 are bottom perspective views of a machine embodiment as in FIG. 1 with the tobacco injection assembly plate removed to expose portions of embodiments of a tobacco injection assembly driver mechanism, a tamper drive mechanism, and a tube holder assembly.
Figure 10:
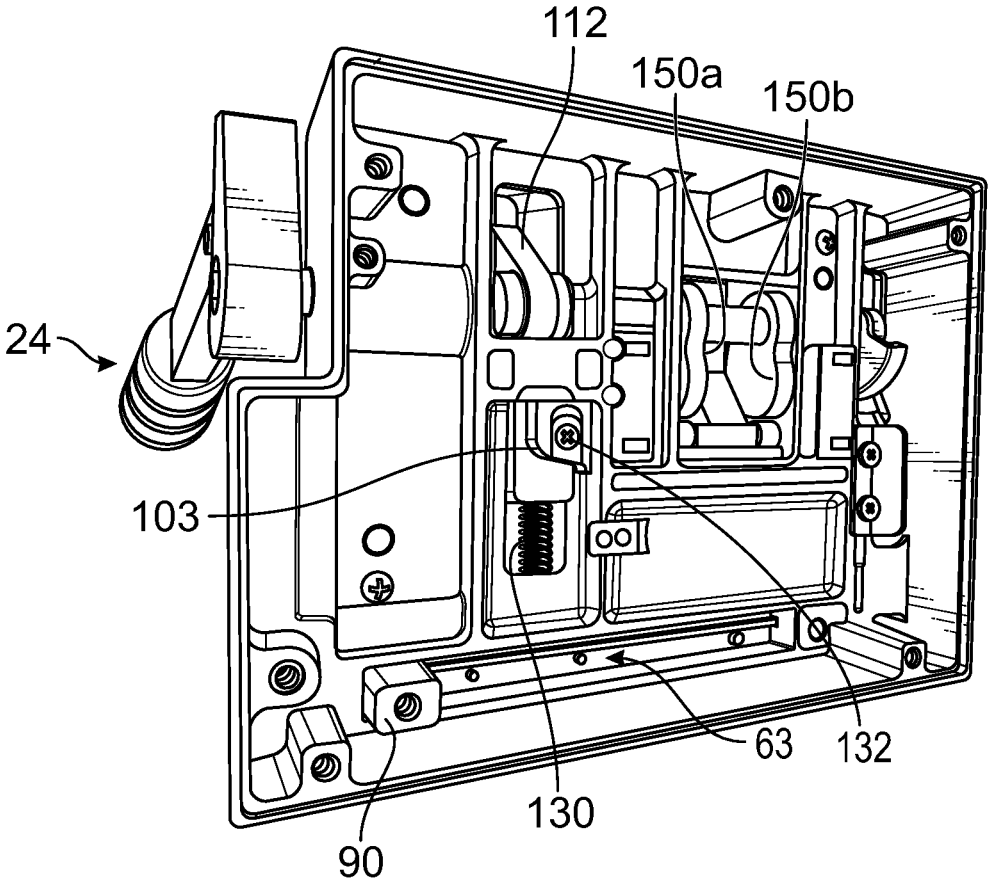
Figure 11:
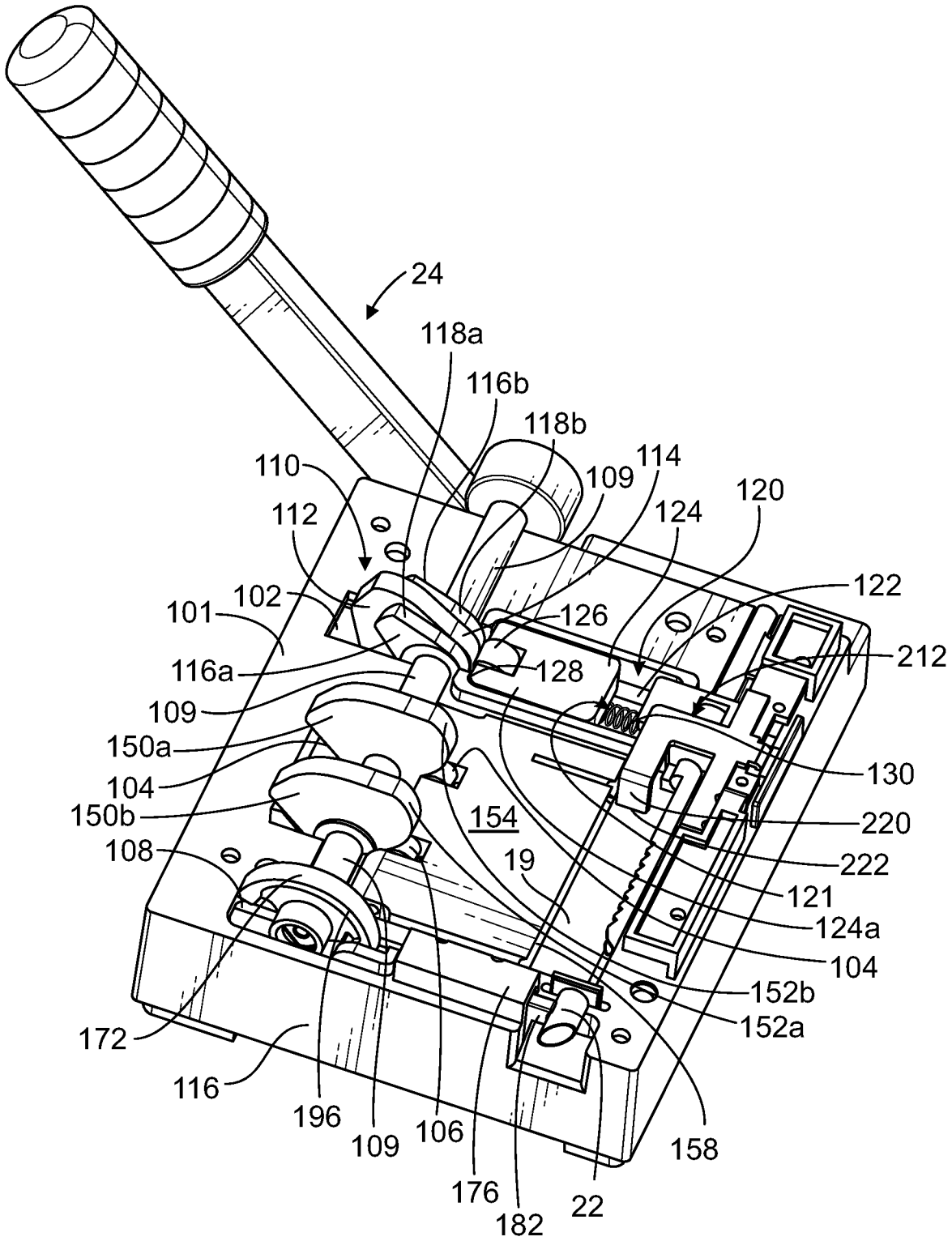
FIG. 11 is a top perspective view of a bottom machine casing component of a machine embodiment as depicted in FIG. 1 exposing portions of the associated tobacco injection drive mechanism, tamper drive mechanism, and tube holder assembly as in FIGS. 8, 9 and 10, as well as an associated compacted tobacco cylinder transport mechanism and a tube nipple.

FIGS. 8-10 are views of the bottom of the cigarette-making machine embodiment 10 with both the bottom cover (not shown in figures) and tobacco injection assembly 48 comprising injection drive plate 50 and its associated features removed. Handle 24 is shown in FIGS. 8-10 attached to driveshaft 100 which passes through a bore (not shown) in side wall 40 of the machine. Turning now to FIG. 11, driveshaft 100 can be seen extending across the top surface 101 of bottom machine casing component 11*b* and is supported in circular recesses 109 in the top surface. Driveshaft 100 bridges a series of cavities 102-108 in top surface 101. Drive shaft 10 may also be viewed in FIG. 11, which depicts portions of the tobacco injection drive mechanism, the tamper drive mechanism, the tube holder assembly, and the compacted tobacco cylinder support transport mechanism of a machine embodiment with the bottom machine casing removed.

A cam assembly 110 seen from above in FIG. 11 and from below in FIGS. 8-10 moves through cavity 102 as handle 24 is rotated during operation of machine embodiment 10. The cam assembly includes a central cam element 112 with a cam surface 114 and lateral stop members 116*a* and 116*b* having respective engagement surfaces 118*a* and 118*b* adjacent to the opposite sides of the central cam element.

FIG. 13 is a cutaway view of the machine embodiment depicted in FIG. 1 taken along a plane perpendicular to the bottom of the machine passing through line 13-13 in FIG. 1. The surface configuration of cam surface 114 can be seen in this figure as including an initial lobe 114*a* leading down to a drop 114*b* and rising to a final lobe 114*c*.

Cam assembly 110 extends through cavity 102 as can be seen in the view of FIG. 11. A track slot 120 is located in top surface 101 and positioned adjacent to and in communication with cavity 102 so that cam assembly 110 may be rotated into and out of an elongated opening 121 in the track slot. The track slot has shoulders 122 along its opposite sides. These shoulders support a carriage plate 124 which rests upon and is designed to slide along the shoulders of the track slot.

Carriage plate 124 includes a wheel 126 mounted for rotation at the front 128 of the carriage plate. A spring 130 biases the carriage plate at the end of the bridge slot opposite cavity 102 with wheel 126 abutting cam surface 114 of central cam element 112. As handle 24 is rotated during the initial operation of the machine, it rotates driveshaft 100 on which the cam assembly is mounted causing cam surface 114 to drive carriage plate 124 down the track slot against the spring resistance provided by spring 130.

Figure 12:
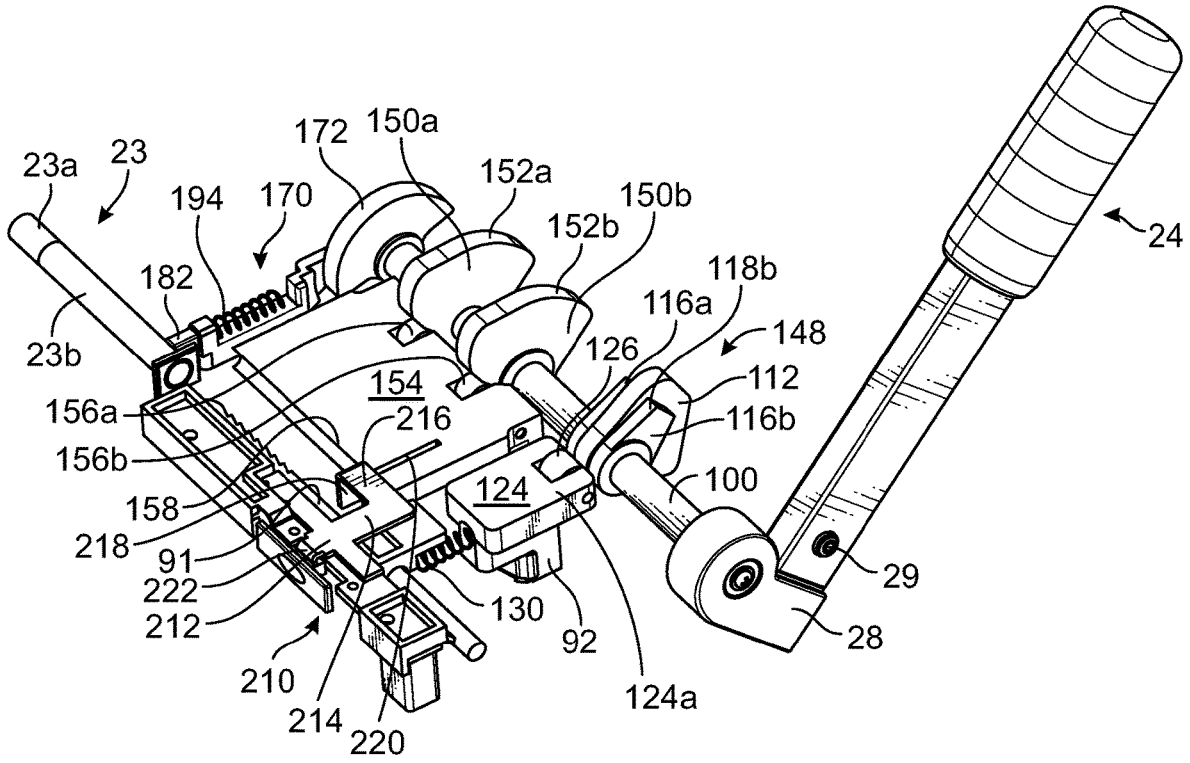
FIG. 12 is a further perspective view of the features depicted in FIG. 11, with the bottom machine casing removed.

As can best be seen in FIG. 12, drive member 92 is affixed to carriage plate 124 and therefore moves with the carriage plate. In this figure, the drive member is affixed to the carriage plate by way of a screw 132 shown in, g, FIG. 10, although the drive member may be affixed to the carriage plate in any manner desired and may be unitary with the carriage plate if desired.

Figure 14A:
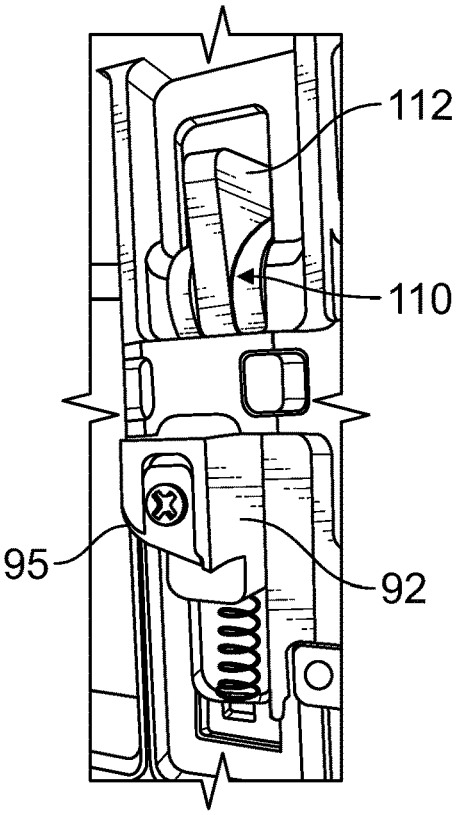
FIGS. 14A-14C are partial perspective views of a portion of the tobacco injection drive mechanism embodiment depicted in FIGS. 8-10.
Figure 14B:
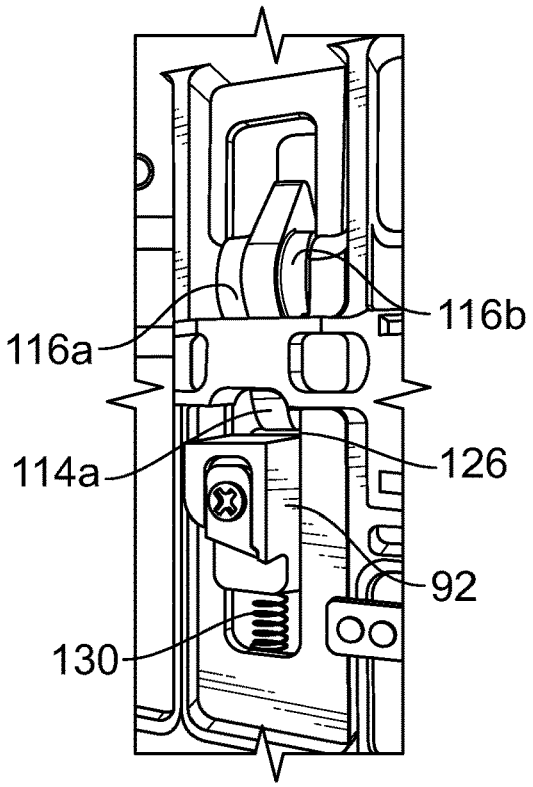
Figure 14C:
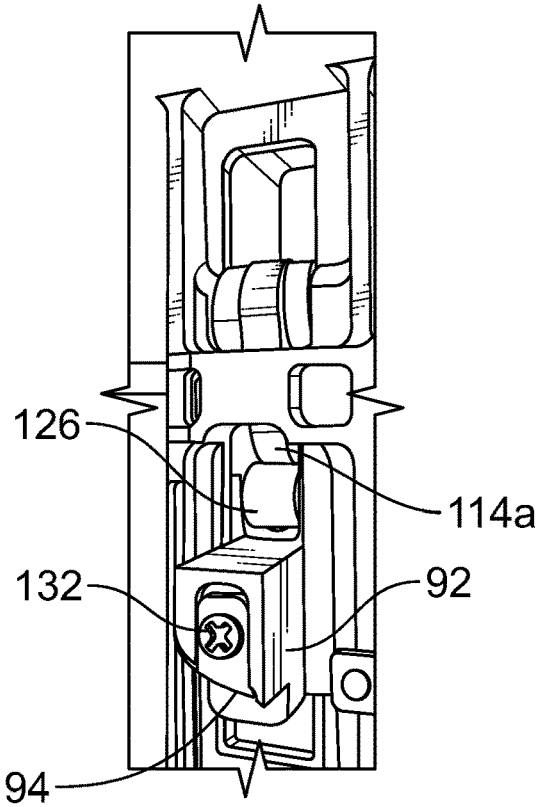
Figure 15:
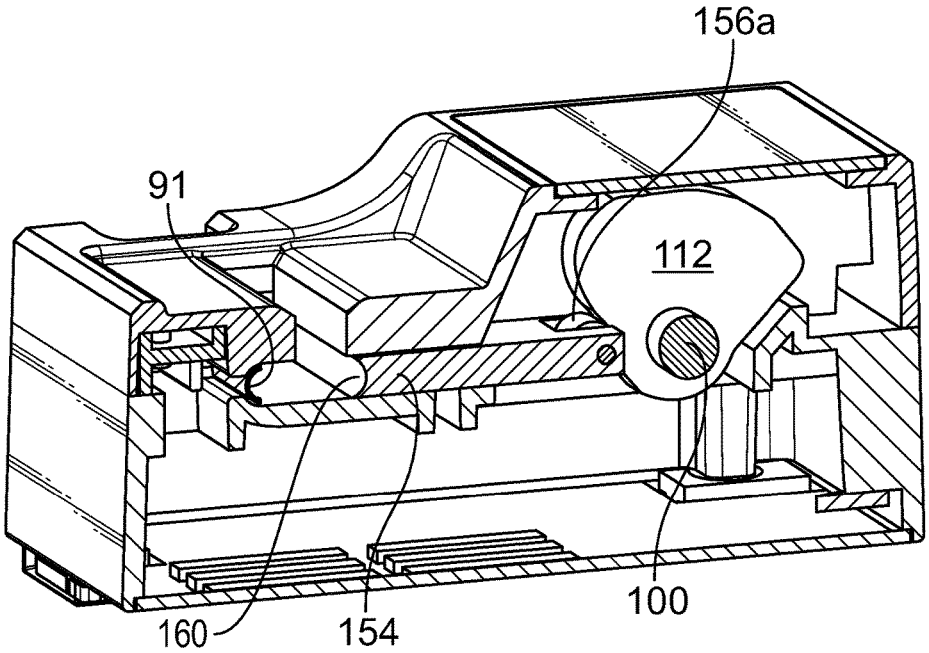
FIG. 15 is a cutaway view of the machine embodiment depicted in FIG. 1 taken along a plane perpendicular to the bottom of the machine passing through line 15-15 in FIG. 1.
Figure 16A:
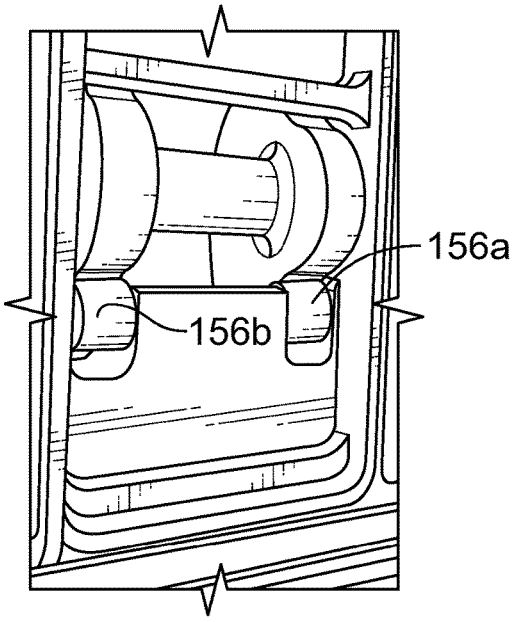
FIGS. 16A-16C are partial perspective views of a portion of the tamper drive assembly embodiment depicted in FIGS. 8-10.
Figure 16B:
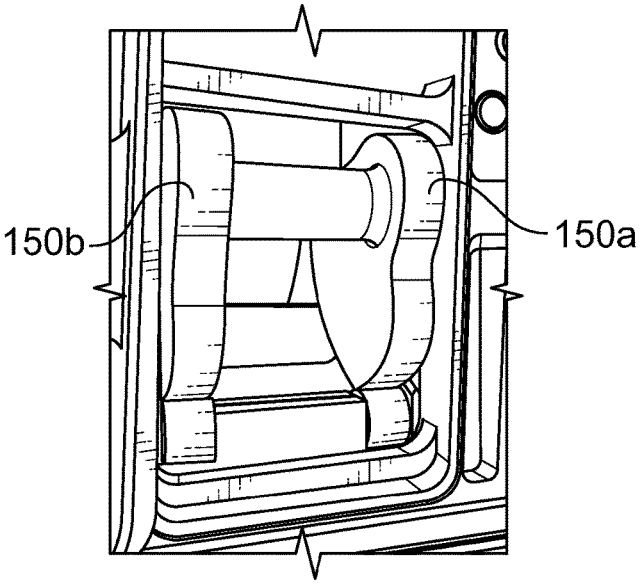
Figure 16C:
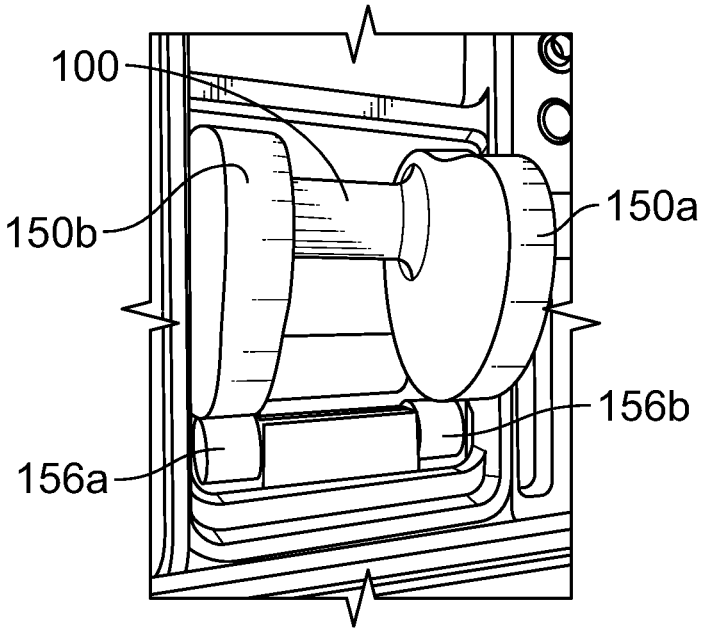

The advancing movement of drive member 92 as the cam assembly is rotated and carriage plate 124 driven down track slot 120 can be seen, for example, by comparing FIGS. 14A, 14B and 14C. FIG. 14A shows the drive member at rest before its movement is triggered by initial lobe 114*a* of the central cam element. In FIG. 14B the drive member has begun moving against the resistance of spring 130. And, in FIG. 14C the drive member has almost reached the end of its range of movement.

FIG. 13 shows carriage plate wheel 126 just after central cam element 112 has rotated past the transition point 114*d* which generally corresponds with the movement of the drive member to the position depicted in FIG. 14B. The central cam element is radially positioned on driveshaft 100 to ensure that transition point 114*d* will first contact wheel 126 when the compacted tobacco cylinder is ready to be injected into tobacco-receiving cylinder of the cigarette tube. Continued rotation of the handle and therefore the cam assembly will cause wheel 126 to follow lobe 114*a* toward drop 114*b* of the cam surface thereby further advancing drive member 92 toward machine housing front wall 36.

This advancing movement of the drive member will cause it to move along elongated shelf 56 of drive plate rectangular opening 52 (FIGS. 4-7) is converted into linear movement of the drive member which in turn causes the drive plate to swing about pivot point 60 so that its free end 64 moves in an arc toward machine front wall 36.

As the cam surface moves past the high point 114*e* of the initial lobe 114*a* of the cam surface, drive member 92 backs off as wheel 126 moves (in response to tension supplied by biasing spring 130) toward and into cam surface drop 114*b*. The continued rotation of handle 24 and therefore cam element 112 further advances drive member 92 toward machine housing front wall 36 to complete the injection process.

The rotary movement of cam assembly 110 is halted as the engagement surfaces 118*a* and 118*b* of the lateral stop members 116*a* and 116*b* of the cam assembly come into abutment with a stop surface. The stop surface may comprise the top surface 124*a* of carriage plate 124 in the illustrated embodiment. The lateral stop members are positioned radially on driveshaft 100 and relative to central cam element 112 to ensure that the lateral stop members come into abutment with the stop surface when the earlier formed compacted tobacco cylinder has been properly and fully injected into a hollow tobacco-receiving cylinder of the cigarette tube. These stop members ensure that the user operating handle 24 will receive a positive tactile signal corresponding to the completion of the injection process so that tobacco spoon 91 may be withdrawn from the fully formed tobacco-containing cigarette tube cylinder 23*b*, as explained earlier.

A tamper mechanism 148 four compacting or compressing loose tobacco in compacting chamber 18 can be seen in FIGS. 8-10, 11, 12, 15, and 16A-16C. The tamper mechanism is positioned in cavity 104 in top surface 101 of the bottom machine casing component. The tamper mechanism includes twin tamper cams 150*a* and 150*b* shown mounted to drive shaft 100 which extends across cavity 104. These cams have respective cam drive surfaces 152*a* and 152*b* (FIG. 11) which are arranged to drive tamper member 154. The tamper member is mounted for movement in cavity 104 in response to the rotation of the tamper cams. The tamper member may be biased in its initial position prior to compaction of loose tobacco in the compacting chamber by a spring (not shown). More particularly, the tamper member includes a pair of rollers 156*a* and 156*b* positioned in the tamper member at its end adjacent the cam drive surfaces. As handle 24 is rotated in an arc, its driveshaft 100 rotates the twin tamper cams which drive the tamper member toward tobacco spoon 91.

A tamping edge 158 is located at the distal edge of tamper member 154. Preferably, the edge will be a rounded trough 160 generally corresponding to the circumference of the compacted tobacco cylinder which is to be injected into the cigarette tube. Preferably a second corresponding trough of like configuration will be located at the bottom of the compacting chamber (not shown).

Thus, when tobacco is placed in compacting chamber 18 (FIG. 1) and handle 24 is then rotated in an arc, the tamper member tamping edge will compress the loose tobacco in the chamber forming an elongated column of compressed tobacco between rounded trough 160 of camping edge 158 and the corresponding trough of like configuration located at the bottom of the compacting chamber.

This compacted tobacco cylinder will then be transported into a hollow tube (not shown) mounted to nipple 22 by the operation of tobacco injection assembly 48 described above. The relative rotary positions of cam assembly 110 and twin tamper cams 150*a* and 150*b* are set so that when the tamper member reaches its final position opposite spoon 91 it is maintained in that position by the maintenance section of the tamper cams at which point surface 114 of central cam element 112 takes over driving the operation of the tobacco injection assembly. Handle 24 and driveshaft 100 will continue to be rotated until engagement surfaces 118*a* and 118*b* of the lateral stop members come to rest against the top surface of bottom machine casing component 11*b*. Handle 24 will be at position 24*a* (FIG. 1) at this time. The handle is then returned to his start position which in turn will also return the tobacco injection assembly and tamper mechanism to their start positions and a filled tobacco tube is removed from nipple 22. Machine embodiment 10 is then ready to be used in forming another cigarette.

We turn now to the tube clamp mechanism 170 of the illustrated embodiment which can be seen in FIGS. 8-10, 11, 12, 13, and 17. This assembly includes a clamp member driver wheel 172 mounted to driveshaft 100. Clamp driver wheel 172 is radially oriented on the driveshaft at central portion 173 so that it can be driven by operation of handle 24. This radial orientation is chosen to ensure that a hollow tube placed on nipple 22 is clamped in place before the elongated, compressed tobacco formed in the compacting chamber 18 is injected into the hollow tube by tobacco injection assembly 48.

Figure 17:
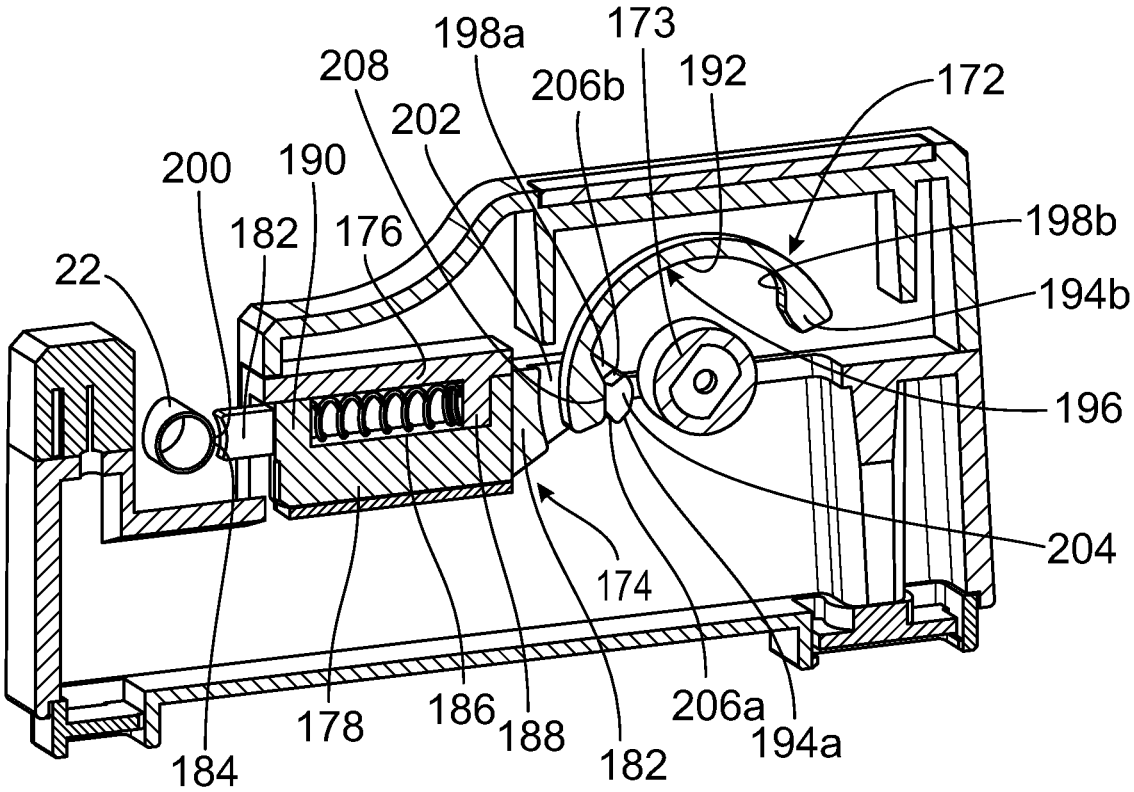
FIG. 17 is a cutaway view of the machine to embodiment depicted in FIG. 1 taken along a plane perpendicular to the bottom of the machine passing through line 17-17 in FIG. 1.
Figure 18A:
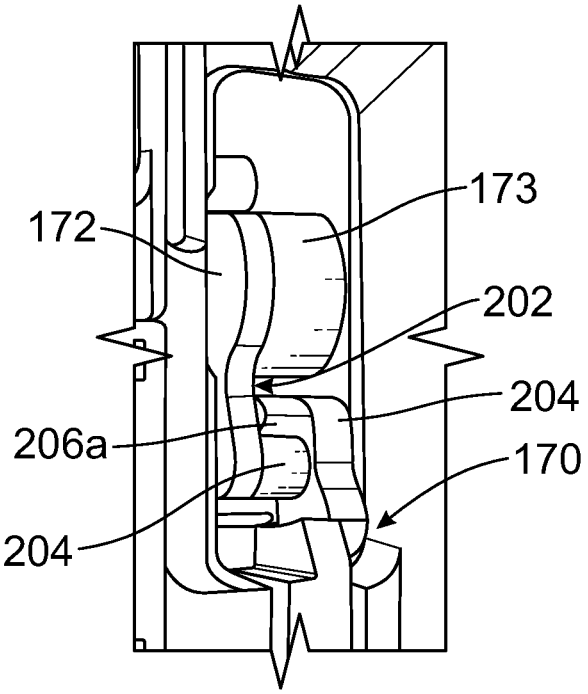
FIGS. 18A-18C are partial perspective views of a portion of the tube holder assembly embodiment depicted in FIGS. 8-10.
Figure 18B:
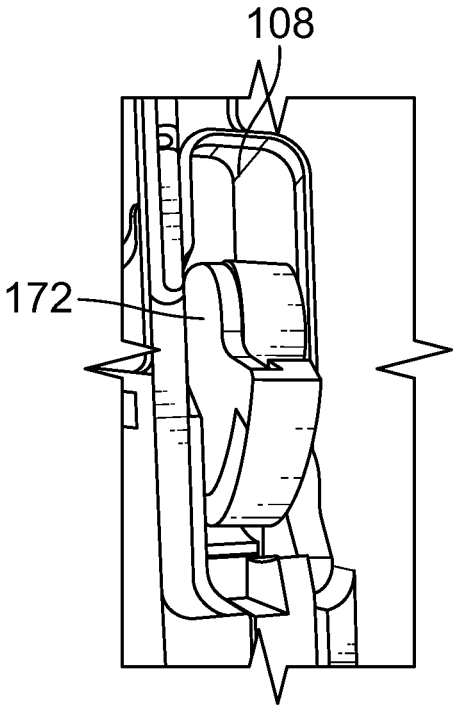
Figure 18C:
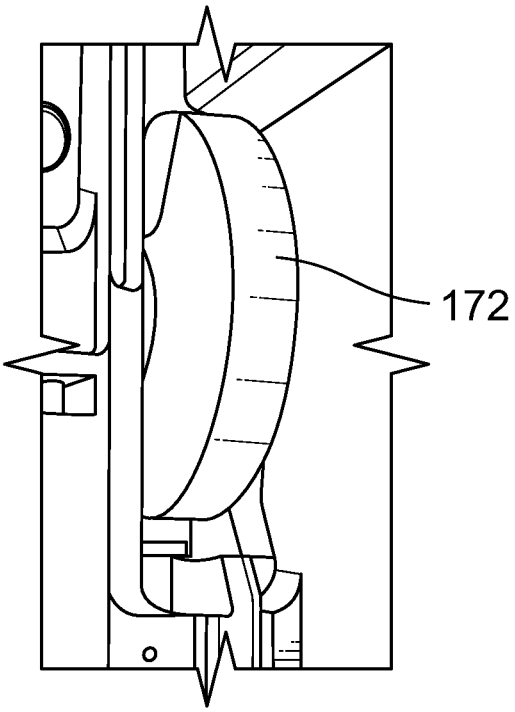

The tube clamp mechanism includes, in addition to driver wheel 172, a clamping structure 174 comprising a fixed top slidable clamping structure portion 176, a movable bottom clamping structure portion 178, a compression spring 180, a distal clamp finger 182 and a proximal drive portion 184 which may best be viewed in FIGS. 11 and 17. The top and bottom clamping structure portions define a cavity 186 which holds compression spring 180 between wall 188 of fixed top clamping structure portion 176 and wall 190 of movable bottom clamping structure portion 178.

As can best be seen in FIG. 11, the clamp driver wheel has a partial laterally extending wall 192 with inwardly directed portions 194*a* and 194*b* at opposite ends of the wall. This wall defines a circular inner surface 196 with inwardly directed ramps 198*a* and 198*b* at portions 194*a* and 194*b*, which can best be seen in the cutaway view of FIG. 17.

Distal clamp finger 172 preferably has a circular distal end cutout 200 of a diameter generally corresponding to the diameter of nipple 22 to maximize contact with an empty cigarette tube mounted to the nipple when the tube clamp mechanism is operated to engage and retain the tube on the nipple.

Finally, proximal drive portion 184 of the tube clamp mechanism includes a clearance slot 202 with a follower finger 204 having ramp edges 206*a* and 206*b* on either side of a landing 208.

The tube clamp mechanism is shown prior to clamping an empty cigarette tube in place on nipple 22 in FIG. 17. This is apparent because of the space shown between the circular distal end cutout 200 of distal clamp finger 182 and the surface of nipple 22. The distal clamp finger is maintained in this position by the proximal force applied at the interface between landing 208 of follower finger 204 and inwardly directed portion 194 a of laterally extending wall 192 which compresses spring 180 in cavity 186. When handle 24 is rotated in this embodiment, driveshaft 100 attached to the handle will rotate clamp driver wheel 172 in a counterclockwise direction causing the follower finger to follow ramp 198*a* toward surface 196. The follower finger maintains contact with the ramp because of the distally directed force applied by the spring. However, the finger may not actually touch surface 196. The movement of the follower finger along the ramp is accompanied by distal movement of the movable bottom of the clamping structure 178 and the distal clamp finger until the distal end cutout of the clamp finger 200 reaches the surface of a hollow tube mounted to nipple 22 under the distal spring force applied by spring 186.

As handle 24 is rotated toward position 24*a* (FIG. 1), follower finger 204 will encounter ramp 198*b* of wall 192 as ramp edge 206*b* moves up on the ramp, drawing movable bottom clamping structure portion 178 proximally thereby also moving clamp finger 182 so that the now filled cigarette tube mounted to nipple 22 will no longer be clamped in place and may be removed.

Cigarette-making machine embodiment 10 is shown with an optional cigarette tube adjustment mechanism 210 which may be seen in FIGS. 11, 12, and 20A-20B. This mechanism enables compacting chamber 18 to be shortened when necessary or desirable to meter the amount of tobacco to accommodate a cigarette tube 23 with a shorter tobacco-receiving cylinder 23*b*.

Cigarette tube adjustment mechanism 210 includes a slide member 212 which is arranged to move laterally between first and second side walls 20 and 40 of the machine housing and directly below compacting chamber access opening 14. The slide member is moved laterally by a slide control plate 214 accessible from front 36 of the machine housing. The slide plate includes a dimpled section 215 to increase friction when a user presses his or her finger against the slide plate in order to change the position of the cigarette tube adjustment mechanism.

Slide member 212 includes a base element 216, a generally perpendicularly directed extension element 218 and a top element 219 which is generally perpendicular to the extension element and parallel to the base element. The base element, extension element, and top element preferably lie in a common plane. Slide member 212 also includes a generally flat tab element 220 directed downwardly into compacting chamber 18. The distal edge 222 of tab element 220 preferably sits against the bottom 19 of compacting chamber 18 (FIG. 11). Finally, base element 216 of the slide member includes a downwardly extending extension 224 which is received in a cavity 226 at the back of slide control plate 214. Slide member 212 may be punched from an appropriately sized metal plate.

Figure 20A:
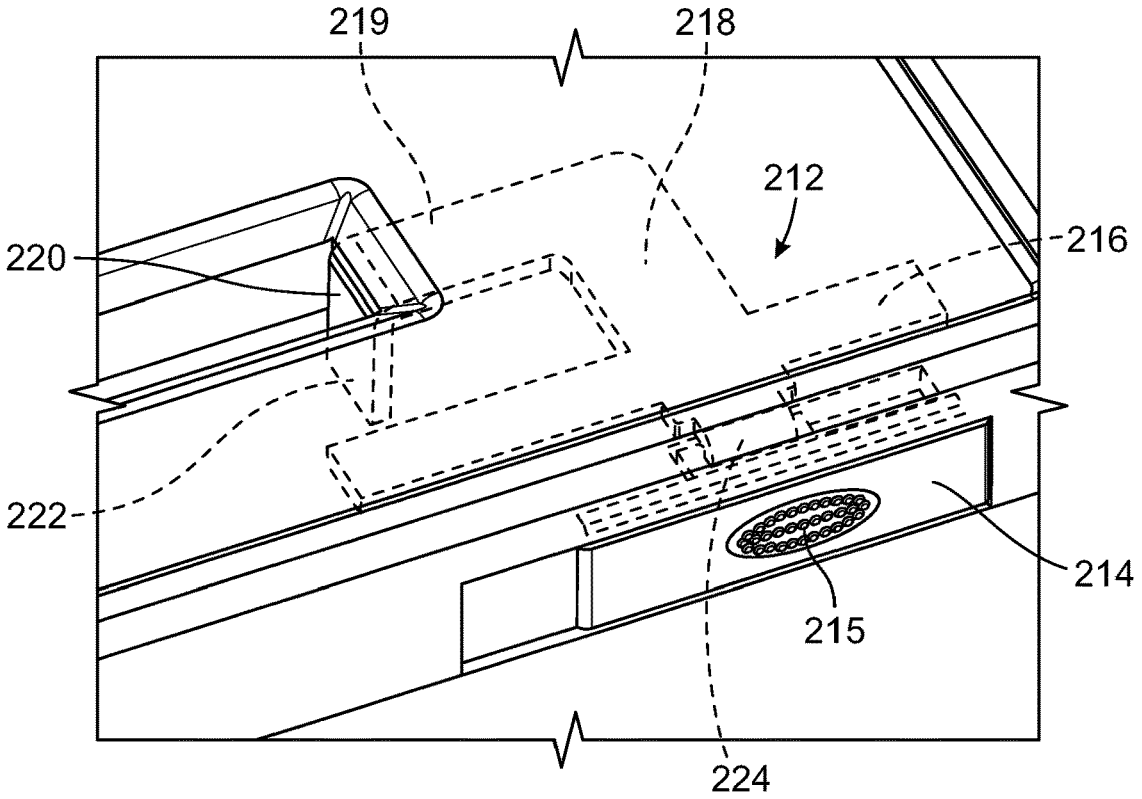
FIGS. 20A and 20B are views of the compacting chamber limiter assembly embodiment identified in FIG. 19.

The operation of the cigarette tube adjustment mechanism may be understood, for example, from FIGS. 20A-20A. Slide member 212 of the adjustment mechanism is shown in its retracted position in FIG. 20A. When it is in this position, the compacting chamber is unobstructed and therefore is able to receive the maximum amount of loose tobacco for filling a first longer tobacco-receiving cylinder of a cigarette tube. And, when tamper member 154 is driven toward tobacco spoon 91 to compact loose tobacco in the compacting chamber, tab element 220 is beside the tamper member and does not interfere with its movement.

Figure 20B:
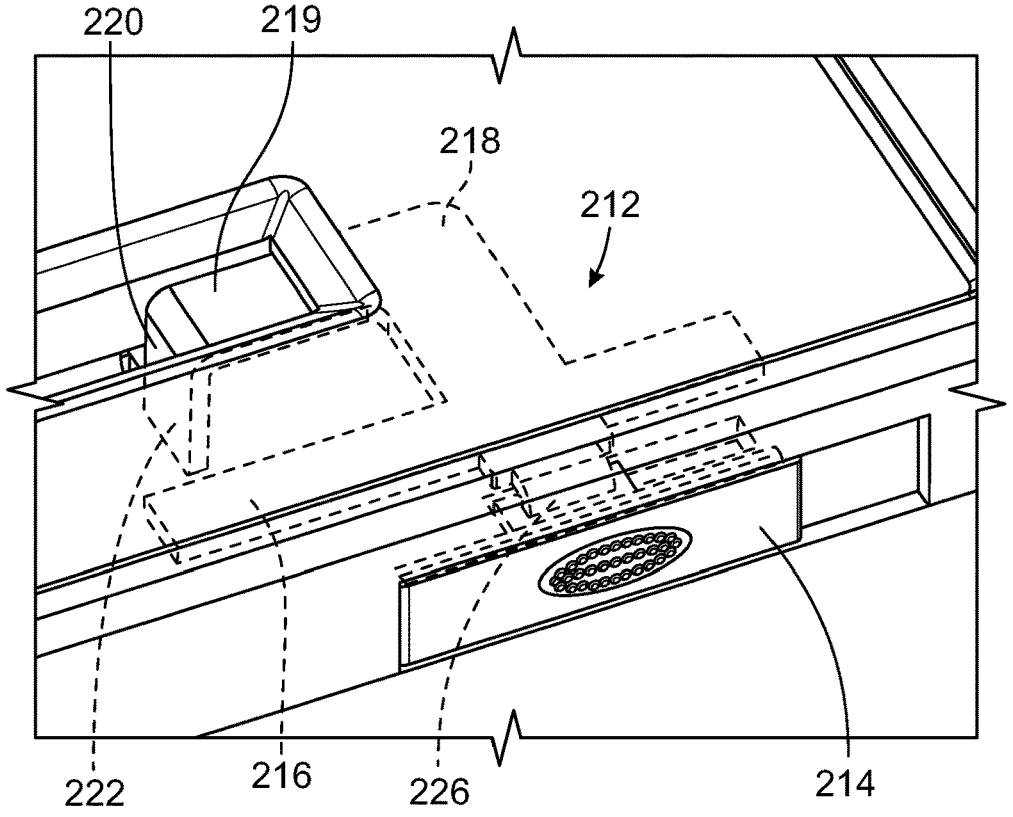

When a second shorter cigarette tube tobacco-receiving the cylinder is to be filled, slide control plate 214 is slid to the left as shown in FIG. 20B (toward first sidewall 20). This moves tab element 220 in the same direction so that tab element 219 now blocks a portion of the chamber effectively shortening the chamber so that it can receive only a reduced amount of loose tobacco for filling a shorter tobacco-receiving cigarette tube cylinder. Tamper member 154 is provided with a slot 228 positioned to correspond to this position of tab element 220 so that the tamper member which moves up the slot as the tamper element is operated to compress loose tobacco in the compacting chamber may be operated without interference with the tab element which moves up the slot as the tamper element is operated to compress loose tobacco in the compacting chamber.

The use of the terms "a" and "an" and "the" and similar references in the context of describing embodiments (especially in the context of the following claims) are to be construed to cover both the singular and the plural, unless otherwise indicated herein or clearly contradicted by context. All methods described herein can be performed in any suitable other unless otherwise indicated herein or otherwise clearly contradicted by context. The use of any and all examples, or exemplary language (i.e., "such as") provided herein, is intended merely to illuminate embodiments and does not pose a limitation on the scope of the embodiments unless otherwise claimed. No language in the specification should be construed as indicating any non-claimed element as essential to the practice of the embodiments.

Preferred embodiments are described herein, including the best mode known to the inventors for carrying them out. Variations of those preferred embodiments may become apparent to those of ordinary skill in the art upon reading the foregoing description. The inventors expect skilled artisans to employ such variations as appropriate, and the inventors intend for the embodiments to be practiced otherwise than as specifically described herein. Accordingly, embodiments include all modifications and equivalents of the subject matter recited in the claims appended hereto as permitted by applicable law. Moreover, any combination of the above-described elements in all possible variations thereof is encompassed embodiments unless otherwise indicated herein or otherwise clearly contradicted by context.

TABLE OF FEATURES

| Identifier | Feature |
|---|---|
| 10 | cigarette-making machine |
| 11 | cigarette machine casing |
| 11a | top machine casing component |
| 11b | bottom machine casing component |
| 12 | lower platform of top machine casing component |
| 14 | compacting chamber access opening |
| 16 | upper platform of top machine casing component |
| 18 | compacting chamber |
| 19 | bottom of compacting chamber |
| 20 | first side wall |
| 21 | cavity in first side wall |
| 22 | nipple |
| 23 | cigarette tube |
| 23a | filter of cigarette tube |
| 23b | tobacco-receiving cylinder of the cigarette tube |
| 24 | handle |
| 24a | handle phantom completion position of handle |
| 25 | handle grip |
| 26 | handle attachment channel |
| 28 | handle-to-machine attachment member |
| 29 | attachment member stub |
| 30 | spring biased pin in attachment member stub |
| 32 | bore in handle attachment channel |
| 34 | elastomeric feet |
| 36 | front wall of machine housing |
| 38 | back wall of machine housing |
| 40 | second side wall |
| 44 | bottom of machine |
| 48 | tobacco injection assembly |
| 50 | injection drive plate |
| 51 | injection drive plate plane of movement |
| 52 | rectangular opening in drive plate |
| 53 | handle plane of movement |
| 56 | elongated shelf along top edge of rectangular opening |
| 60 | pivot end of drive plate |
| 62 | pivotal mounting member |
| 63 | injection track |
| 64 | free end of injection drive plate opposite plate pivot end |

-continued

TABLE OF FEATURES

| Identifier | Feature |
|---|---|
| 65 | start point of injection track |
| 66 | link arm |
| 68 | swing arm |
| 70 | intermediate attachment point along section of swing arm |
| 72, 74 | two sections of swing arm |
| 76 | tobacco injector drive arm return spring |
| 77 | articulation pivot point in swing arm |
| 78 | return spring anchor point |
| 79 | distal end of swing arm |
| 80 | return spring attachment to swing arm |
| 81 | intermediate point on bottom of link arm |
| 90 | tobacco spoon slide support |
| 91 | tobacco spoon |
| 92 | drive member |
| 93 | upstanding portion of drive member |
| 94 | angled flat leading surface of drive member |
| 96 | point on drive member closest to start point of injection track |
| 98 | point on drive member closest to nipple |
| 99 | hardened insert of drive member |
| 100 | driveshaft |
| 101 | top surface of bottom machine casing component |
| 102-108 | cavities in top surface of bottom machine casing component |
| 109 | circular recesses in top surface of bottom machine easing component |
| 110 | cam assembly |
| 112 | central cam element |
| 114 | cam surface |
| 114a | initial lobe of cam surface |
| 114b | drop of cam surface |
| 114c | final lobe of cam surface |
| 114d | transition point of initial cam lobe |
| 114e | high point of initial lobe of cam surface |
| 116a, 116b | lateral stop members of cam assembly |
| 118a, 118b | engagement surfaces of lateral stop members |
| 120 | track slot in top surface of bottom machine casing component |
| 121 | elongated opening in track slot |
| 122 | shoulders along opposite sides of track slot |
| 124 | carriage plate |
| 124a | top surface of carriage plate |
| 126 | wheel of carriage plate |
| 128 | front of carriage plate |
| 130 | spring that biases carriage plate at end of bridge slot |
| 132 | screw |
| 148 | tamper mechanism |
| 150a, 150b | twin tamper cams |
| 152a, 152b | tamper cam drive surfaces |
| 154 | tamper member |
| 156a, 156b | tamper member rollers |
| 158 | tamping edge |
| 170 | tube clamp mechanism |
| 172 | clamp driver wheel |
| 173 | central portion of clamp driver wheel |
| 174 | clamping structure |
| 176 | fixed top slidable clamping structure portion |
| 178 | movable bottom clamping structure portion |
| 180 | compression spring |
| 182 | distal clamp finger |
| 184 | proximal drive portion |
| 186 | cavity holding compression spring |
| 188 | wall of fixed top clamping structure portion |
| 190 | wall of movable bottom clamping structure portion |
| 192 | partial laterally extending wall of clamp driver wheel |
| 194a, 194b | Inwardly directed portions of laterally extending wall |
| 196 | circular inner surface of clamp drive wheel |
| 198a, 198b | inwardly directed ramps of inwardly directed portions of wall |
| 200 | circular distal end cutout of distal clamp finger |
| 202 | clearance slot |
| 204 | follower finger |
| 206a, 206b | ramp edges of follower finger |
| 208 | landing of follower finger |
| 210 | cigarette tube adjustment mechanism |

-continued

TABLE OF FEATURES

| Identifier | Feature |
|---|---|
| 212 | slide member of cigarette tube adjustment mechanism |
| 214 | slide control plate |
| 215 | dimpled section of slide control plate |
| 216 | base element |
| 218 | extension element |
| 219 | top element |
| 220 | tab element |
| 222 | distal edge of tab element |
| 224 | base element extension |
| 226 | cavity in back of slide control plate |
| 228 | slot in tamper member |

What is claimed is:

1. A manual cigarette making machine comprising:

a machine casing;

a compacting chamber within the machine casing for receiving loose tobacco, the compacting chamber having a longitudinal axis;

a handle mounted for rotation relative to the machine casing, the handle being attached to a driveshaft extending into the machine casing, the driveshaft having a rotational axis that is parallel to the longitudinal axis of the compacting chamber;

a tamper operated by a radially asymmetrical member mounted to the driveshaft, the radially asymmetrical member engaging a follower coupled to the tamper for advancing the tamper toward the compacting chamber to compress loose tobacco in the compacting chamber;

a tobacco injection assembly including an injection drive plate rotatably operated by the driveshaft; and a tobacco spoon linked to the tobacco injection assembly for transporting compressed tobacco from the compacting chamber in response to rotation of the injection drive plate.

2. A manual cigarette making machine as in claim 1 in which an attachment member stub is affixed to the driveshaft and the handle has an attachment channel for removably receiving the stub.

3. A manual cigarette making machine as in claim 2 in which the stub has a spring-biased pin and the attachment channel has a wall with a bore positioned to receive the pin to facilitate removably attaching the handle to the stub.

4. A manual cigarette making machine as in claim 1 in which:

the handle rotates in a plane;

the injection drive plate of the injection assembly is mounted for movement in a plane generally perpendicular to the plane of rotation of the handle.

5. A manual cigarette making machine as in claim 1 in which the injection drive plate of the injection assembly includes a pivot end and a free end spaced from the pivot end and the free end is coupled to the tobacco spoon to transport the tobacco spoon for conveying compressed tobacco from the compacting chamber.

6. A manual cigarette making machine as in claim 5 in which:

the tobacco spoon is mounted for linear movement along an injection track and the free end of the injection drive plate moves in an arc;

a swing arm is rotatably mounted at one end to the machine casing and at the other end to the tobacco spoon; and the free end of the injection drive plate is linked to the swing arm, whereby pivotal movement of the injection drive plate is converted into linear movement of the tobacco spoon.

7. A manual cigarette making machine as in claim 6 in which the swing arm is articulated.

8. A manual cigarette making machine as in claim 5 including:

a drive member mounted for linear movement generally perpendicular to the axis of the driveshaft; and an opening located in the injection drive plate spaced from the pivot end of the plate for receiving the drive member whereby linear movement of the drive member produces pivotal movement of the injection drive plate about the pivot end of the injection drive plate.

9. A manual cigarette making machine as in claim 8 in which the opening includes a shelf that is generally perpendicular to the injection drive plate and the drive member engages the shelf as it moves linearly.

10. A manual cigarette making machine as in claim 9 in which the drive member has an angled flat leading surface that engages the shelf.

11. A manual cigarette making machine as in claim 10 in which the flat leading surface has a hardened portion where it contacts the shelf to reduce wear.

12. A manual cigarette making machine as in claim 1 in which the tobacco injection assembly is driven by a cam assembly operated by the driveshaft.

13. A manual cigarette making machine as in claim 12 in which the cam assembly includes a central member with a cam surface and a lateral stop member.

14. A manual cigarette making machine as in claim 12 in which the cam assembly includes a central cam member having a cam surface including an initial lobe, a drop and a final lobe for maintaining the tobacco injection assembly in place during the operation of the tamper mechanism and carrying out the injection of compacted tobacco following the completion of the operation of the tamper mechanism.

15. A manual cigarette making machine as in claim 1 in, wherein the follower includes one or more wheels for engaging the radially asymmetrical member to move the tamper relative to the compacting chamber.

16. A manual cigarette making machine as in claim 1 including a nipple for receiving an open end of a cigarette tube and clamping structure for removably retaining the cigarette tube on the nipple to receive compacted tobacco transported from the compacting chamber.

17. A manual cigarette making machine as in claim 16 in which the clamping structure is operated by the driveshaft.

18. A manual cigarette making machine as in claim 1 in which the machine includes a cigarette tube adjustment mechanism for reducing the tobacco-receiving volume of the compacting chamber.

19. A manual cigarette making machine as in claim 1 in which the radially asymmetrical member of the tamper mechanism and a radially asymmetrical member of the tobacco injection assembly are positioned radially on the driveshaft to first complete the tamping process and then initiate and complete the injection process.

20. A manual cigarette making machine comprising:

a machine casing;

a compacting chamber within the machine casing for receiving loose tobacco, the compacting chamber having a longitudinal axis;

a handle mounted for rotation relative to the machine casing;

a driveshaft coupled to the handle, the driveshaft extending into the machine casing, the driveshaft rotatable about a rotational axis, the rotational axis extending parallel to the longitudinal axis of the compacting chamber;

a first cam mounted to the driveshaft and rotated by the driveshaft;

a tamper operated by the first cam, the tamper configured to move toward the compacting chamber to compress loose tobacco in the compacting chamber;

a second cam mounted to the driveshaft and rotated by the driveshaft; and a tobacco spoon operated by the second cam, the tobacco spoon configured to transport compressed tobacco from the compacting chamber.

21. A manual cigarette making machine comprising:

a machine casing;

a compacting chamber within the machine for receiving loose tobacco;

a handle mounted for rotation relative to the machine casing;

a driveshaft rotatably driven by the handle, the driveshaft extending into the machine casing;

a first cam coupled to the driveshaft for co-rotation the driveshaft;

a first follower configured to translate relative to the driveshaft due to interaction with the first cam;

a tamper coupled to the first follower, the tamper configured to advance toward the compacting chamber to compress loose tobacco in the compacting chamber;

a second cam coupled to the driveshaft for co-rotation with the driveshaft;

a second follower configured to translate relative to the driveshaft due to interaction with the second cam;

a drive member coupled to the second follower;

an injection drive plate rotatably driven by translation of the drive member;

a tobacco spoon linked to the injection drive plate, the tobacco spoon configured to transport compressed tobacco from the compacting chamber in response to rotation of the injection drive plate.

* * * * *